United States Patent [19]

Sinclair et al.

[11] Patent Number: 4,925,530

[45] Date of Patent: May 15, 1990

[54] LOADED PAPER

[75] Inventors: Peter Sinclair; Angela J. Hayes, both of Buckinghamshire, England

[73] Assignee: The Wiggins Teape Group Limited, Basingstoke, England

[21] Appl. No.: 222,346

[22] Filed: Jul. 20, 1988

Related U.S. Application Data

[63] Continuation of Ser. No. 943,082, Dec. 18, 1986, abandoned.

[30] Foreign Application Priority Data

Dec. 21, 1985 [GB] United Kingdom ..... 8531558

[51] Int. Cl.[5] ..... D21H 17/33

[52] U.S. Cl. ..... 162/164.1; 162/164.3; 162/164.6; 162/168.1; 162/168.2; 162/168.3; 162/181.1; 162/181.2; 162/181.8; 162/183

[58] Field of Search ..... 162/175, 181.1, 181.2–181.7, 162/183, 168.2, 168.3, 164.6, 164.3, 181.8, 164.1

[56] References Cited

U.S. PATENT DOCUMENTS

| | | | |
|---|---|---|---|
| 2,838,397 | 6/1958 | Gruntfest et al. . | |
| 2,913,364 | 11/1959 | Miller . | |
| 2,943,013 | 6/1960 | Arledter . | |
| 2,949,397 | 8/1960 | Werner . | |
| 3,146,157 | 8/1984 | Morgan et al. . | |
| 3,184,373 | 5/1965 | Arledter . | |
| 3,563,907 | 2/1971 | Nadeau et al. . | |
| 3,660,338 | 5/1972 | Economou . | |
| 3,873,336 | 3/1975 | Lambert et al. . | |
| 4,066,495 | 1/1978 | Voigt et al. . | |
| 4,103,080 | 7/1978 | Bohmer et al. . | |
| 4,178,205 | 12/1979 | Wessling et al. . | |
| 4,187,142 | 2/1980 | Pickelman et al. . | |
| 4,189,345 | 2/1980 | Foster et al. . | |
| 4,210,490 | 7/1980 | Taylor | 62/183 |
| 4,225,383 | 9/1980 | McReynolds . | |
| 4,294,885 | 10/1981 | Sunden . | |
| 4,299,654 | 11/1981 | Tiach et al. . | |
| 4,405,744 | 9/1983 | Greinecker et al. . | |
| 4,439,496 | 3/1974 | Tamagawa et al. | 428/516 |
| 4,445,970 | 5/1984 | Post et al. . | |
| 4,487,657 | 12/1984 | Gomez . | |
| 4,545,854 | 10/1985 | Gomez et al. . | |
| 4,675,245 | 6/1987 | Von Meer | 428/328 |

FOREIGN PATENT DOCUMENTS

| | | |
|---|---|---|
| 15007 | 5/1983 | Australia . |
| 0050316 | 4/1972 | European Pat. Off. . |
| 0003481 | 7/1978 | European Pat. Off. . |
| 0011303 | 5/1980 | European Pat. Off. . |
| 0060291 | 9/1980 | European Pat. Off. . |
| 0020316 | 12/1980 | European Pat. Off. . |
| 0041056 | 12/1981 | European Pat. Off. . |

(List continued on next page.)

OTHER PUBLICATIONS

"Charge Relationships of Dual Polymer Retention Aids", Edgar E. Moore, vol. 59, No. 6, Jun. 1976/Tappi.

"Retention and Bonding of Synthetic Dry Strength Resins", W. F. Linke, vol. 51, No. 11, Nov. 1968/Tappi.

"Interaction of Cationic Clay Particles with Pulp Fibers", B. Alince and P. Lepoutre, Tappi Journal/Jan. 1983.

(List continued on next page.)

*Primary Examiner*—Peter Chin

*Attorney, Agent, or Firm*—Burns, Doane, Swecker & Mathis

[57] ABSTRACT

Aqueous suspensions of papermaking fibres and filler are each separately treated with an anionic or a cationic polymer, after which the filler (preferably) or the papermaking fibre is treated with a polymer of opposite charge to that used in the initial treatment. The filler and papermaking suspensions are then mixed to form a papermaking stock, with dilution as necessary before, during or after the mixing operation. This stock is then used to form a loaded paper web in conventional manner. The initial treating polymer is preferably a papermaking retention aid or flocculant, e.g. a cationic polyarcylamide or an amine/amide/epichlorohydrin copolymer in the case of cationic materials or an anionic polyacrylamide in the case of anionic materials. The further treating polymer is preferably an anionic or cationic starch, depending on the charge of the initial treating polymer.

37 Claims, 9 Drawing Sheets

U.S. PATENT DOCUMENTS

| | | |
|---|---|---|
| 50316 | 4/1982 | European Pat. Off. . |
| 0080986 | 6/1983 | European Psat. Off. . |
| 0100370 | 9/1983 | European Pat. Off. . |
| 0132132 | 1/1985 | European Pat. Off. . |
| 2817262 | 4/1978 | Fed. Rep. of Germany . |
| 85/02635 | 6/1985 | PCT Int'l Appl. . |
| 86/00100 | 1/1986 | PCT Int'l Appl. . |
| 82015454 | 3/1984 | Sweden . |
| 82015967 | 3/1984 | Sweden . |
| 82055922 | 6/1984 | Sweden . |
| 1282551 | 7/1972 | United Kingdom . |
| 1353015 | 5/1974 | United Kingdom . |
| 1371600 | 10/1974 | United Kingdom . |
| 1425114 | 2/1976 | United Kingdom . |
| 1429796 | 3/1976 | United Kingdom . |
| 1451108 | 9/1976 | United Kingdom . |
| 1497280 | 1/1978 | United Kingdom . |
| 1505641 | 3/1978 | United Kingdom . |
| 1527077 | 10/1978 | United Kingdom . |
| 2001088 | 1/1979 | United Kingdom . |
| 1177512 | 6/1979 | United Kingdom . |
| 2009277 | 6/1979 | United Kingdom . |
| 1552243 | 9/1979 | United Kingdom . |
| 2016498 | 9/1979 | United Kingdom . |
| 2031475 | 4/1980 | United Kingdom . |
| 1581548 | 12/1980 | United Kingdom . |
| 1588016 | 4/1981 | United Kingdom . |
| 2125838 | 3/1984 | United Kingdom . |

OTHER PUBLICATIONS

"Benefits of Dual Retention Aid Systems", A. Fowler (vol. 187, No. 3, 1977), Paper, Feb. 7, 1977.

"First Pass Fines Retention Critical to Efficiency of Wet Strength Resin", E. R. Sandstrom, Paper Trade Journal, Jan. 30, 1979.

"40% Filler Loaded Paper . . . Dream or Reality?", Mrs. A. J. Hayes, Paper Technology and Industry, May 1985.

"The Hylode System for Fibre Replacement", R. D. Mather, Pira Seminar.

"Production of Paper at High Filler Levels", R. D. Mather, Papermakers Conference, 1982.

"Some Aspects for Filler Optimisation", D. S. Gardner, Pira Seminar.

"Production and Application Experience of High--Filled CTMP-Containing Papers", Per Batelson.

"The Use of Calcium Carbonate Filler and a Neutral Sizing Agent in Offset Printing Paper", S. Faktorowitsch et al.

"Ways to Increased Filler Content of Paper at Constant Strength", A. Breunig, Wiggins Teape, May 8, 1981.

J56-123498, "Paper Prodn. with Fixed Calcium Carbonate . . . ", Abstract.

"Retention Chemistry", U. E. Unbehend et al.

"The Superfilled Paper with Rattle" (Translation from Swedish with Swedish Language Attached).

"The Superfilled Paper with Rattle", Tissue Today, Paper-Dec. 5, 1983.

Translation, DE 3 412 535 A, pulbihsed Oct. 1984, "Paper Production Process".

"Method for Making Paper with Improved Strength by Pretreatment of Filler", J55-163298, abstract.

"Praktische und theoretische Ergebnisse aif dem Gebiet der mit EPI-Polyamin-Polyamid-Harz erzugten nabfesten Papier", vol. 10A, Year 23, pp. 672-682 (1969), only the summary considered.

"Polyacrylamide as a Stock Additive", Tappi, vol. 45, No. 4, Apr. 1962.

EXAMPLE 8 - KAOLIN

LOADED PAPER

This application is a continuation of application Ser. No. 06/943,082, filed Dec. 18, 1986 now abandoned.

BACKGROUND OF THE INVENTION

This invention relates to loaded paper and its production.

It is conventional to load paper with fillers in order, for example, to improve the opacity, whiteness and printability of the paper, and/or to reduce the cost of the paper (fillers are normally cheaper than the cellulose fibres which they replace). A drawback of the use of fillers is that the strength and other properties of the paper are impaired. This has had the effect of imposing limits on the proportion of filler which can be incorporated in the paper.

Fillers are normally incorporated in the paper web during its formation on the papermaking wire. This is achieved by having the filler present in suspension in the papermaking stock, so that as the stock is drained on the wire, suspended filler particles are retained in the resulting wet fibrous web. A problem with such a system is that quite a high proportion of filler is entrained in the water draining through the wire, rather than being retained in the web, and is therefore potentially lost. This problem is particularly serious with relatively lightweight papers. Although losses can be minimised to a considerable extent by re-use of this drained water in making up further papermaking stock, loss of filler as a result of imperfect retention in the web adds significantly to the cost of the paper produced.

As the cost of papermaking pulp, fillers and energy has increased, much effort has been devoted to the development of techniques which facilitate attainment of higher loading levels without unacceptable deterioration in paper properties, particularly strength and stiffness, and/or increased filler retention during formation of the web on the papermaking wire.

Such techniques have in the main involved the treatment of the filler particles and sometimes also the papermaking fibres, with one or more natural or synthetic polymers. These polymers may be charged in order to produce an interaction with the filler particles and/or the papermaking fibres, both of which are themselves normally negatively charged when in suspension in papermaking stock. A general review of the subject is to be found in a chapter entitled "Retention Chemistry" by J. E. Unbehend and K. W. Britt forming part of "Pulp and Paper-Chemistry and Chemical Technology", Third Edition, edited by James P. Casey, Volume 3, (Chapter 17). This Chapter discloses, inter alia, the sequential use of low-molecular weight cationic polymer followed by high-molecular weight anionic polymer, which is stated to offer particular benefits.

The patent literature also contains numerous proposals for filler treatment, and sometimes also fibre treatment as well. A number of these proposals are outlined below by way of example:

(i) UK Patent No. 1347071 discloses the treatment of fillers with cationic and anionic starches, so as to coat the filler particles with a coagulated or precipitated starch mixture. The coated filler is stated to exhibit improved retention characteristics. No pre-treatment of papermaking fibre with polymer(s) is disclosed.

(ii) UK Patent No. 1497280 discloses the treatment of filler particles with an anionic polymeric flocculant and a counter-acting anionic deflocculant. Papermaking fibres may be present during this treatment, and a cationic polymeric retention aid such as a polyacrylamide or a cationic starch may be added as a stock addition to the fibre/filler mixture. The treatment disclosed is stated to give improved strength at a given loading level, and hence to enable a higher proportion of relatively cheap filler to be included in a paper of given strength, which leads to considerable economic advantage. There is no disclosure of separate treatment of filler and papermaking fibre with polymeric materials, or of pre-treatment of filler with cationic polymeric material.

(iii) UK Patent No. 1505641 discloses the treatment of filler particles with an anionic latex, optionally after it has been treated with a cationic polymer such as a cationic starch. This treatment is stated to permit a high proportion of filler to be present in the paper without significant deterioration of mechanical properties. No pre-treatment of papermaking fibre with polymer(s) is disclosed.

(iv) UK Patent No. 1552243 discloses the treatment of filler particles with charged polymers, e.g. high molecular weight acrylamide polymers or copolymers, to form a filler/polymer conglomerate for use as a loading material in paper. Polymeric wet-or dry-strength resins may be present when the filler is treated. The treated filler is then mixed with papermaking fibre, after which polymeric retention aids may be added. A paper web is then formed in the normal way. The use of the treated filler is stated to permit increases in the filler content of the paper without substantially affecting the physical strength characteristics of the paper.

(v) UK Patent Application No. 2016498A discloses the treatment of filler particles simultaneously with inter alia, a cationic polyacrylamide and an anionic starch, and the use of the thus treated filler as a loading in paper. Excellent retention is stated to be obtained. There is no disclosure of treatment of papermaking fibres with polymer(s).

(vi) European Patent Application No. 50316A discloses the treatment of filler particles with a conventional papermaking organic binder and a cationic polymeric flocculant before being mixed with fibres. The fibres may be pre-treated with an anionic polymeric retention aid.

(vii) European Patent Application No. 60291A, equivalent to and published as International Patent Application No. WO/01020, discloses the reaction of a cationic starch with an anionic polyelectrolyte to form an "amphoteric mucus" which is then mixed with filler and/or papermaking fibres, after which an inorganic polymer of high surface charge is added to produce a partially dehydrated mucus gel-coated filler/fibre structure which is then used in a papermaking furnish. This is stated to give high filler retention and to produce papers of high strength and high filler content. Broadly similar proposals using different combinations of charged polymers are to be found in Swedish Patent Application Nos. 8201545A; 8201596A and 8205592A.

(viii) International Patent Application No. WO/02635 discloses the addition of a cationic starch of specified degree of substitution, an anionic polymer of specified molecular weight and a cationic synthetic polymer to a filler-containing papermaking stock in order to improve retention. There is no disclosure of the separate treatment of filler and fibre.

(ix) U.S. Pat. No. 4487657 (equivalent to European Patent Application No. 6390A) discloses the addition of an inorganic flocculant or an organic polymeric flocculant to an aqueous suspension of filler and fibres, followed by the addition of an organic binder, followed by a further flocculant addition. There is no disclosure of separate treatment of filler and fibre.

(x) European Patent Application No. 3481A discloses the addition of an aqueous mixture of filler and an ionically-stabilized charged latex to an aqueous fibre dispersion, followed by destabilization of the resulting mixture, for example by means of a charged polymer. A paper web is then formed in conventional manner. Normal papermaking additives may also be used.

(xi) UK Patent Application No. 2085492A discloses the addition of an ionic latex and at least one cationic polymer to an aqueous filler/fibre suspension which is then drained in conventional manner to produce a highly-loaded paper web suitable for use as a good quality fine printing paper. There is no disclosure of separate treatment of filler and fibre.

(xii) Japanese Laid-Open Patent Publication No. 55-163298 discloses pre-treatment of filler with a cationic polyacrylamide and pre-treatment of fibre with anionic polyacrylamide, after which the treated filler and fibre are mixed and a paper web is formed in conventional manner. The paper web is stated to have improved surface strength.

(xiii) German Offenlegungsschrift 3412535A discloses the addition of a polysaccharide, for example a cationic starch, and a synthetic retention aid to a papermaking pulp suspension. A pre-treated filler, for example a filler which has been anionically dispersed and then treated with cationic starch, may be added to the pulp suspension prior to formation of a paper web in conventional manner.

The patent literature also contains proposals for the treatment of papermaking fibres to improve paper strength. For example, U.S. Pat. Nos. 3660338; 3677888; 3790514; and 4002588 disclose treatment of papermaking fibres with "polysalt coacervates" derived by mixing dilute solutions of anionic and cationic polyelectrolytes. This is stated to give rise to paper of improved dry strength. European Patent Application No. 100370A discloses mixing an anionic polymer solution with a cationic polymer solution and then adding the resulting mixture to papermaking fibres. This is stated to give rise to a paper of excellent strength. European Patent Application No. 921A discloses the treatment of negatively-charged papermaking fibres with a mixture of a cationic latex and an anionic polymer and the use of the thus treated fibres for the production of a high strength paper composite. European Patent Application No. 96654A discloses the addition of an anionic sizing agent and a cationic retention aid to a pulp suspension which may also contain filler. Paper of good mechanical properties is stated to be obtained. UK Patent No. 1177512 discloses the treatment of papermaking fibres sequentially with a cationic component comprising both aluminium ions and a cationic polymer and an anionic component comprising an anionic polymer. This is stated to give a wet web having improved drainage characteristics. U.S. Pat. No. 3146157 discloses the use of polysulfonium and polycarboxylate resins for fibre treatment in order to obtain papers of improved strength. None of these patents disclosing fibre treatment to improve paper strength also discloses treatment of fillers with polymers.

An article entitled "The superfilled paper with rattle" by Lindström and Kolseth in "Paper", 5th Dec. 1983 discloses that paper of high filler content and high strength may be obtained by treating a filler/fibre mixture with both cationic starch and an anionic polyacrylamide or with other cationic polymer/anionic polymer combinations. A similar but somewhat longer article appears in STFI Kontakt, No. 3/82, at pages 3 to 5.

Other proposals for the treatment of fillers and/or fibres with natural or synthetic polymers to improve retention or paper strength and/or to obtain other effects may be found, for example, in UK Patent Specifications Nos. 11282551; 1353015; 1371600; 1429796; 1451108; 1527077; 1581548; 2001088A; 2009277A; 2016498A; and 2125838A; in U.S. Pat. Nos. 2943013 and 3184373; in European Patent Specifications Nos. 41056A; 80986A; and 132132A; and in International Patent Application No. WO 86/00100 (published after the priority date hereof).

A problem experienced with quite a number of the previous proposals is that while the processes appear promising at laboratory scale, or under carefully controlled larger-scale trial conditions, they fail to maintain their performance in regular production on the paper machine, where high shear forces are encountered. A further problem is that the polymers needed tend to be expensive, and so can only be used in small quantities which are perhaps inadequate to produce significant benefits. However, at least some of the technology disclosed in the publications reviewed above is though to have been commercialised, and this has enabled progress to be made with regard to the objectives stated earlier. Nevertheless, there is still scope for further progress, and this is the object of the present invention.

SUMMARY OF THE INVENTION

The present invention is based on the discovery that benefits are achieved if both the filler and the papermaking fibres are treated separately with charged polymers before being mixed and if the polymer treatment of the filler or the fibre involves the use of two oppositely charged polymers rather than a single charged polymer. The mechanisms involved have not yet been conclusively identified, but it is thought that an important feature of the invention is the occurrence of phase separation of the charged polymers with which the filler and fibre have been treated, so as to give rise to concentration of the polymer in a polymer-rich phase which serves to bond filler and fibre together. This polymer-rich phase is also thought to enhance inter-fibre bonding in the final paper web. The concentration of the polymer as a result of phase separation is believed to result in increased efficiency and effectiveness and less waste compared with the above-mentioned prior art processes which also utilise polymers to improve filler retention and/or paper strength.

It will be noted that none of the numerous prior art proposals mentioned above discloses a process as described in the previous paragraph.

Accordingly, the present invention provides in a first aspect a process for the production of loaded paper from papermaking fibre and filler, comprising the steps of:

(a) treating the papermaking fibre in an aqueous medium with a charged polymer;

(b) separately treating the filler in an aqueous medium with a charged polymer of the same charge polarity as the polymer used in step (a);

(c) additionally treating the filler or the papermaking fibre with a charged polymer of opposite charge polarity from that of the polymer(s) used in steps (a) and (b), this additional treatment taking place after, before or at the same time as the step (a) and/or step (b) treatment(s);

(d) mixing aqueous suspensions of treated filler and treated papermaking fibre from steps (a) to (c) to form a papermaking stock, diluting as necessary before, during or after the mixing operation; and (e) draining the papermaking stock to form a loaded paper web.

In a second aspect, the present invention provides a loaded paper made by a process as just defined.

DETAILED DESCRIPTION OF THE PREFERRED EMBODIMENTS

Figures 1A, 1B:
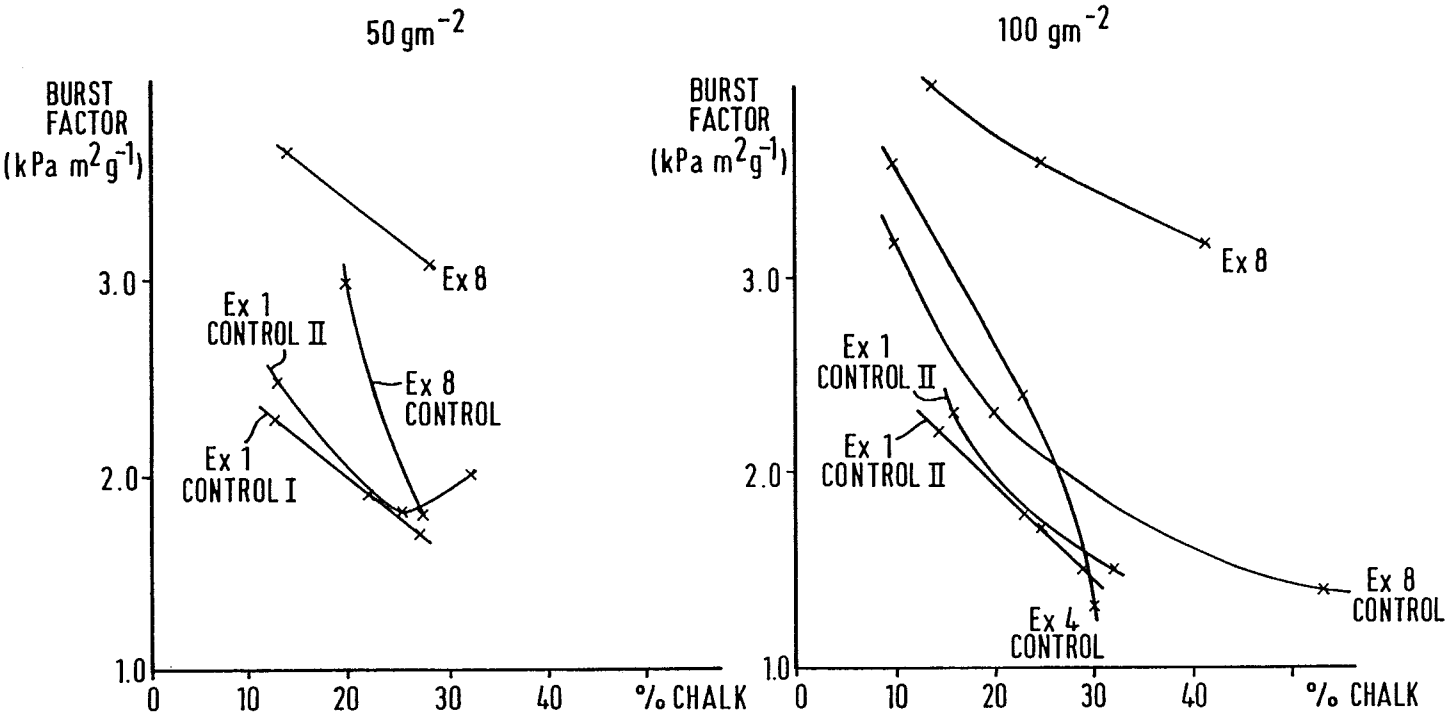
FIGS. 1A, 1B, 1C and 1D are graphical illustrations of the results obtained from Example 8 relating to burst values obtained at given chalk loading levels.
Figures 1C, 1D:
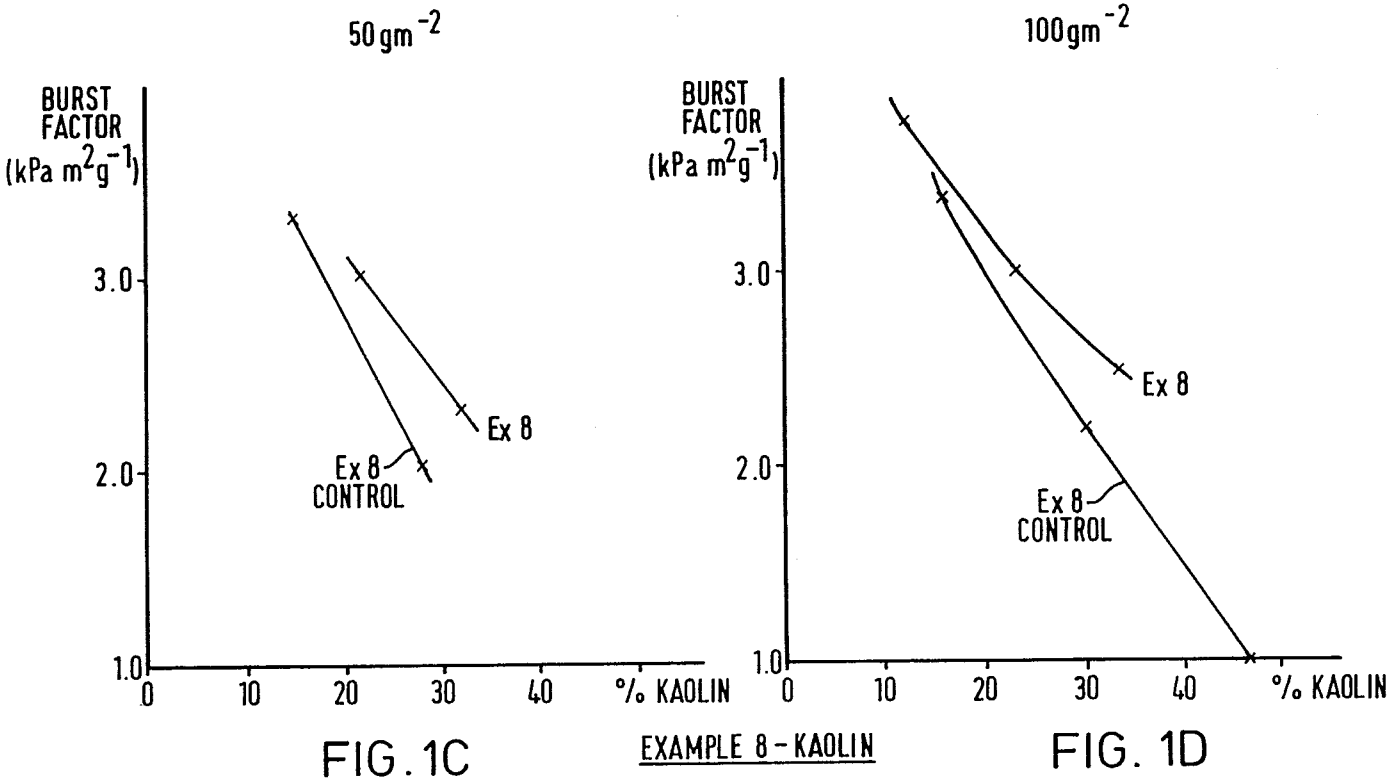

Preferably, it is the filler which is the subject of the step (c) additional treatment, and the additional treatment is carried out after the step (a) treatment. In principle however, the order of the step (c) treatment and either the step (a) or step (b) treatment could be reversed, i.e. the "additional" step (c) treatment could in fact precede the step (a) or step (b) treatment of the fibre or filler respectively. A further alternative is the mixing of the additional treating polymer of step (c) and the treating polymer of step (a) or step (b) prior to treatment of the fibre or filler respectively. The polymers used in the step (a) and step (b) treatments are conveniently the same, but in principle they need not be, subject of course to the proviso that they are of the same charge polarity.

The charged polymer used in steps (a) and (b) above for fibre or filler or treatment respectively may be either positively-or negatively-charged. Since the filler particles and fibres are themselves normally weakly negatively-charged when in aqueous suspension, it might be thought at first sight that mutual repulsion between a negatively-charged polymer and the suspended filler particles or fibres would preclude their effective treatment by a negatively-charged polymer in steps (a) and (b) of the present process, but this has been found not to be the case in practice. Indeed, the use of a negatively-charged polymer in steps (a) and (b) has in some instances been found to be the preferred mode of operation.

The effect of the filler or papermaking fibre treatment in steps (a) and (b) is thought, in most cases at least, to be that the treating polymer becomes adsorbed on to, or otherwise becomes associated with, the surface of the filler particles or fibres (regardless of the polarity of the polymer charge or of the polarity of the charge on the filler or the fibre). This produces, or at least can conveniently be viewed as producing, a species having a net charge polarity corresponding to that of the treating polymer. The charge associated with the polymer will either outweigh or reinforce the charge originally present on the filler particles or fibres.

It is thought that an interaction occurs between the positively-and negatively-charged polymers during the step (c) treatment. This is thought to give rise to phase separation to produce a relatively polymer-rich phase and a relatively polymer-deficient phase (provided the concentration and other conditions are suitable, as discussed subsequently). The polymer-rich phase produced is thought to concentrate or deposit around the suspended filler or fibre particles, probably as a result of free energy considerations, i.e. the phase separated product, being relatively hydrophobic, surrounds the filler particles or fibres in order to minimise their interface with water molecules.

It is thought that mixing of treated filler and treated fibre in step (d) leads to further polymer interaction and phase separation. This supplements the amount of polymer-rich phase which may already be present as a result of the step (c) treatment.

In order to promote this further phase separation, the amounts of treating polymers used in steps (a) to (c) should in general be chosen such that the polarity of the polymer-treated filler or fibre system from step (c) is opposite to that of the polymer-treated fibre or filler system from step (a) or step (b) respectively. The polymer-rich phase produced is thought to concentrate or deposit around the filler and fibre present for the same reasons as are discussed above in the context of filler treatment. If for some reason no phase separation occurs as a result of the step (c) treatment, the subsequent mixing during step (d) affords a further opportunity for phase separation.

Treatment of filler rather than fibre in step (c) is thought to be preferable because the initial concentration of the filler particles and their binding one to another by means of the separated polymer-rich phase prior to contact with the fibres is inherently more important in terms of filler retention and paper properties than fibre to fibre bonding prior to contact with the filler. The need for good fibre to fibre and fibre to filler bonding can be adequately catered for by the step (d) mixing operation, whereas it is more difficult to achieve adequate filler to filler bonding when only a single polymer is used for filler treatment prior to mixing of filler and fibre.

The foregoing explanation of the mechanisms involved in the various treatment steps is offered as an aid to understanding only. Whilst it represents the applicants'current understanding of the process, this understanding is not yet complete, and the applicants do not therefore wish to be bound by the explanation given.

Phase separation of polymer solutions into polymer-rich and polymer-deficient phases is in itself a well-known phenomenon, which has found commercial utility in, for example, the field of microencapsulation. The phase separation believed to occur in the present process is thought to be liquid-liquid phase separation, rather than precipitation, flocculation or agglomeration to produce a solid phase, although again, the applicants do not wish to be bound by their current understanding of the mechanisms involved. Coacervation is an example of liquid-liquid phase separation and is thought to be involved in the present process, at least in its preferred embodiments. However, a precise definition of coacervation has in the past been a matter for considerable debate, and this term has therefore not been used in defining the present process. Nevertheless, in carrying out the present process, factors known to be significant in the coacervation field should be taken into account, for example the concentration of the polymers used. Background information on coacervation may be found in numerous patents on microencapsulation by coacervation, e.g. U.S. Pat. Nos. 2,800,457 and 2,800,458.

As is well known, there is an upper limit of concentration at which liquid-liquid phase-separation can take place, at least if coacervation is involved. Whilst the exact level of this upper limit is not known with certainty, it is probably in the region of 10% by weight. The steps in the present process which are thought to involve phase separation should therefore desirably be carried out at polymer concentrations below 10%, and preferably below about 5%.

In practice, this condition is unlikely to be constricting. Polymers generally cost more than paper fibres, and so for economic reasons the ratio of polymer to fibre must be very low. In view of the very low concentration of fibres in the papermaking process, the polymer concentration is likely to be always well within the range needed for liquid-liquid phase separation. Such considerations would not necessarily preclude the use of higher polymer concentrations during the filler and fibre treatment stages, but in practice, viscosity considerations would make the use of concentrations in excess of about 5% in these stages unlikely.

A further factor to be taken into account is the strength of charge of the polymers used. If a dilute solution of one polymer (e.g. 3% by weight) is added to a dilute solution of the other polymer, then phase separation should take place. If both polymers are very strongly-charged, a precipitate may be formed, which is thought to be generally undesirable in the present process. If both polymers are only weakly-charged then the yield of phase separated product may be very low. These extremes are therefore best avoided in the present process.

As the addition of one polymer solution to the other continues, the yield of phase separated product will increase. This can be monitored, if required, by analysis of the two phases. Maximum phase separation is thought to occur around the position of charge balance. If the charges on the polymers are of unequal strength, then it is to be expected that a larger amount of the weakly-charged polymer and a smaller amount of the strongly-charged polymer would be needed. From a commercial viewpoint, this would be convenient, since strongly-charged polymers are generally expensive, and the bulk of the phase separated product would consist of the less expensive weakly-charged polymer. Thus it is preferable in the present process to use a relatively large amount of relatively weakly-charged polymer and a relatively small amount of relatively strongly-charged polymer. Most anionic and cationic starches are examples of weakly-charged polymers. Many polymers and resins marketed as papermaking retention aids and/or as flocculants, e.g. for effluent treatment, are examples of strongly-charged polymers.

It is important to note that pH may enhance or suppress a given charge. For example, in acid solution the cationic character of a cationic polymer will be increased and the anionic character of an anionic polymer diminished. In alkaline solution, the reverse is true. These effects are potentially utilisable as an aid to controlling or operating the present process.

Although a wide range of cationic polymers and a wide range of anionic polymers are usable in the present process, it should be appreciated that not every possible combination of cationic and anionic polymers will work satisfactorily. For example, if the polymers used are not well matched in terms of their charge strengths, good results will not be obtainable. Guidance as to suitable polymer combinations is of course available from the specific Examples detailed later. Factors such as concentration and quantities of polymer used must of course also be taken into account when assessing the suitability of a particular polymer combination.

Cationic polymers which may be used in the present process include polyacrylamides and amine/amide/epichlorohydrin copolymers ("AAE copolymers"), particularly those of the kind sold for use as papermaking retention aids or flocculants, starches, particularly those sold for use as papermaking strength agents, polymeric quaternary ammonium compounds such as poly(diallyldimethylammonium chloride) ("DADMAC" polymer) and polyamines. Although commonly used as a cationic polymer in coacervation processes, gelatin is not generally suitable for use in the present process, since it tends to gel at ambient temperature, even at low concentrations.

Anionic polymers which may be used include polyacrylamides, particularly those of the kind sold for use as papermaking retention aids or flocculants, starches, particularly those sold for use as papermaking strength agents, and other modified polysaccharides, for example gums, carboxymethyl cellulose and copolymers of maleic anhydride with ethylene, vinyl methyl ether, or other monomers. Gum arabic should also be usable, although it tends to be of uncertain availability and may be contaminated with bark and such like, and so may require preliminary filtration or other treatment.

When an anionic or cationic papermaking retention aid or flocculant is used for the steps (a) and (b) treatments, the amount of polymer used for the step (a) fibre treatment is preferably at least 0.15% by weight, more preferably 0.2 to 0.4% by weight, based on the dry weight of the fibre, and for the step (b) filler treatment is preferably at least 0.1% by weight, more preferably from 0.2% or 0.3% to 1.0% by weight, based on the dry weight of the filler. The amount of anionic or cationic starch used in the step (c) treatment is preferably at least 4% by weight, more preferably 5% or 8% to 10% by weight, based on the dry weight of the filler. The weight ratio on a dry basis of retention aid or flocculant to starch is preferably from 1:6 to 1:40, more preferably from 1:6 to 1:14, in the case of a cationic retention aid or flocculant and an anionic starch, and from 1:12 to 1:100, more preferably from 1:24 to 1:40, in the case of an anionic retention aid or flocculant and a cationic starch.

The preferred polymer concentration in the aqueous medium used for both filler and fibre treatment has so far been found to be up to about 5% by weight, for example 4% by weight, in the case of polymers of relatively low molecular weight, e.g. AAE copolymers or cationic or anionic starches, but only about 0.5% by weight for higher molecular weight polymers such as cationic or anionic polyacrylamides. The solids content of the filler suspension during the filler treatment is typically up to about 35% by weight, for example 15 to 25% by weight. After treatment, the treated filler suspension is added to the treated fibre suspension at any of a number of points in the stock preparation or approach flow system, for example in the mixing box, after mixing or refining, in the machine chest or at the fan pump. It has so far been found preferable for the addition to be just after a region of turbulence in the stock preparation or approach flow system, for example after the refiners. Routine experimentation can be employed to determine the optimum point of addition for a particular treating system and papermachine.

Whilst the filler and fibre are normally made up into respective aqueous suspensions before being treated with polymer, it would in principle be possible for dry filler or dry fibre to be added directly to aqueous polymer solution.

Although mixing of treated filler and treated fibre is preferably carried out after dilution of the fibre suspension to papermaking consistency, it would in principle be possible to carry out the mixing operation prior to such dilution. If this is done the polymer concentrations might not be conducive to phase separation, which might therefore only occur on dilution.

Although dilution has been referred to above as the factor most likely to influence phase separation, it is well-known in the art that phase separation can be induced or promoted by other means, for example pH adjustment or salt addition. Such expedients may in principle also be used in the present process.

The filler used in the present process may be any of those conventionally used in the paper industry, for example kaolin, calcium carbonate, talc, titanium dioxide, aluminosilicates etc. The weight ratio of filler to total amount of treating polymer used is typically around 12:1 to 15:1, although this will of course depend on the particular polymers used.

The web-forming stage of the present process, i.e. step (e), may be carried out on any conventional paper machine, for example a Fourdrinier paper machine.

Acid-sizing (i.e. rosin/alum sizing) or neutral/alkaline sizing (e.g. alkyl ketene dimer or succinic anhydride derivative sizing) may be employed in the present process. Although the presence of a highly-charged cationic species ($Al^{3+}$) in acid sizing systems might be expected to influence the charged polymers present, this has been found in practice to have no marked effect on the operation of the process or on the properties of the paper obtained.

In a particularly preferred embodiment, the present invention provides a process for the production of loaded paper from papermaking fibre and filler, comprising the steps of:

(a) treating the papermaking fibre in an aqueous medium with a cationic polymer;
(b) separately treating the filler in an aqueous medium with a cationic polymer;
(c) treating the thus-trated filler with an anionic polymer;
(d) mixing aqueous suspensions of treated papermaking fibre from step (a) and treated filler from (b) and (c) to form a papermaking stock, diluting as necessary before, during or after the papermaking operation; and
(e) draining the papermaking stock to form a loaded paper web.

Preferably, the polymer used in both steps (a) and (b) of this particularly preferred process is a cationic retention aid or flocculant, for example a cationic polyacrylamide or a cationic amine/amide/epichlorohydrin copolymer, and the polymer used in step (c), is an anionic starch. Preferably, the cationic retention aid or flocculant is used in an amount of from 0.2 to 1.0% by weight in steps (a) and (b), based on the dry weight of the fibre or the filler, and the anionic starch is used in an amount of from 5 to 10% by weight, based on the dry weight of the filler.

In a further particularly preferred embodiment, the present invention provides a process for the production of loaded paper from papermaking fibre and filler, comprising the steps of:

(a) treating the papermaking fibre in an aqueous medium with an anionic polymer;
(b) separately treating the filler in an aqueous medium with an anionic polymer;
(c) treating the thus-treated filler with a cationic polymer;
(d) mixing aqueous suspensions of treated papermaking fibre from step (a) and treated filler from steps (b) and (c) to form a papermaking stock, diluting as necessary before, during or after the papermaking operation; and
(e) draining the papermaking stock to form a loaded paper web.

Preferably, the polymer used in both steps (a) and (b) of this further particularly preferred process is an anionic retention aid or flocculant, for example an anionic polyacrylamide, and the polymer used in step (c) is a cationic starch. Preferably the anionic polymer is used in an amount of from 0.2 to 0.4% by weight in steps (a) and (b), based on the dry weight of the fibre or the filler, and the cationic starch is used in an amount of from 8 to 10% by weight, based on the dry weight of the filler.

The invention will now be illustrated by the following Examples, in which all parts are by weight unless otherwise stated, and in which all retention values quoted are approximate and are based on the total weight of filler and fibre only:

EXAMPLE 1

This illustrates a process in which papermaking fibre and filler are treated separately with a cationic polymer, and in which the treated filler is then further treated with an anionic polymer before the treated fibre and filler are mixed to produce a papermaking stock. Three different polymer treatment levels were used, and two controls using generally known technology were also run.

(a) Fibre treatment

A 4% aqueous fibre suspension containing 20 kg of fibre on a dry basis was prepared. The fibre was a blend of 70% bleached sulphate eucalyptus pulp and 30% bleached sulphate mixed softwood pulp, which had been refined (together) to a wetness of approximately 30°–35° Schopper-Riegler (SR). 1.66 kg of a 5% aqueous solution of a cationic amine/amide/epichlorohydrin (AAE) copolymer ("Percol 1597" supplied by Allied Colloids Limited of Bradford, United Kingdom) were added to the fibre suspension with stirring. The AAE copolymer content of the suspension was 83 g, or about 0.4% based on the weight of fibre present.

(b) Filler treatment

A 25% chalk slurry containing 15 kg of chalk was prepared. X kg of 5% aqueous suspension of AAE copolymer ("Percol 1597") were added, and the resulting mixture was stirred well. Y kg of a 5% solution of anionic starch ("Solvitose C5" a cross-linked carboxymethylated maize starch supplied by Tunnel Avebe of Rainham, Kent, United Kingdom) were added, and the mixture was stirred well.

The values of X and Y, and the resulting polymer contents were as follows:

| | X (kg) | Wt of AAE Copolymer (g) | % of AAE Copolymer * | Y (kg) | Wt of anionic starch (kg) | % of anionic starch* |
|---|---|---|---|---|---|---|
| Run 1 | 2.86 | 143 | 0.95 | 34 | 1.7 | 11.0 |
| Run 2 | 2.08 | 104 | 0.70 | 25 | 1.25 | 8.3 |
| Run 3 | 1.66 | 83 | 0.55 | 20 | 1.00 | 6.7 |

*based on weight of chalk in each case

The approximate weight ratios of filler:anionic starch:AAE copolymer (and of filler:anionic starch) for Runs 1, 2 and 3 were as follows:

| | | |
|---|---|---|
| Run 1 | 105:12:1 | (9:1) |
| Run 2 | 144:12:1 | (12:1) |
| Run 3 | 180:12:1 | (15:1) |

(c) Mixing of filler and fibre suspensions/papermaking

The treated chalk slurry was added to the fibre suspension at three different addition levels at the mixing box of a pilot-scale Fourdrinier papermachine. These addition levels were such that the resulting stocks contained about 21%, 43% and 64% chalk, based on the total weight of fibre and chalk (these levels are only approximate as they are affected by the constancy of flow provided by the various pumps in the system, which is imperfect). An alkyl ketene dimer sizing agent ("Aquapel 2" supplied by Hercules Ltd.) was added so as to give a total alkyl ketene dimer content of 6 g, or 0.03% based on the weight of fibre present in each stock. These stocks were then drained to produce paper webs of target grammage 100 g $m^{-2}$ and 50 g $m^{-2}$ in the normal way. A 5% solution of solubilized starch ("Amisol 5592", supplied by CPC United Kingdom, of Manchester, United Kingdom) was applied by means of a size press on the papermachine. The pick-up was such as to produce a solubilized starch content of approximately 2.5% in the final paper web, based on the fibre content of the web.

(d) Control I - Preflocculated filler 2 kg of a 0.35% solution of a polyacrylamide flocculating agent ("Percol E24" supplied by Allied Colloids Ltd.) were added to a 25% chalk slurry containing 15 kg of chalk. The polyacrylamide content of the resulting mixture was 7 g, or 0.047% based on the weight of chalk present. The treated chalk slurry was then added to an untreated 4% aqueous fibre suspension containing 20 kg dry fibre (same blend as described in section (a) above). The chalk addition was made at the machine chest of the papermachine described in section (c) above, and was in three portions, so as to give the same chalk contents as described in section (c) above. The mixtures were each diluted to papermaking consistency and sized with alkyl ketene dimer as described in section (c) above, before being made into paper webs of target grammage 100 g $m^{-2}$ and 50 g $m^{-2}$. Size press sizing was carried out as described in section (c) above.

(e) Control II - Filler treated with cationic starch 7 kg of a 5% solution of cationic starch ("Amisol 5906", a quaternary ammonium substituted maize starch supplied by CPC United Kingdom) were added to a 25% chalk slurry containing 15 kg of chalk. The starch content of the resulting mixture was 350 g, or 2.3% based on the weight of chalk present. The procedure was then as described in section (d) above, with the starch-treated chalk slurry being used in place of the polyacrylamide-treated chalk slurry.

(f) Results obtained

The papers made were each subjected to a full range of standard tests, including ash content (i.e. loading level or amount of filler retained in the web). The approximate one pass filler retention (also frequently termed first-pass retention) was calculated from the ash content (this value is approximate only as it does not allow for variations in pump flow rates and the effect this has on the filler level in the stock).

The results of the ash content determinations, and the retention values calculated from them are set out in Table 1 below.

TABLE 1

| Target grammage (g $m^{-2}$) | Target filler addition % | Making | Ash content (%) | One-pass retention (%) | Filler: starch AAE copolymer ratio |
|---|---|---|---|---|---|
| 100 | 21 | Control I | 16 | 76 | — |
| | | Control II | 14 | 67 | — |
| | | Run 1 | 20 | 95 | 105:12:1 |
| | | Run 2 | 21 | 100 | 144:12:1 |
| | | Run 3 | 23 | 100+* | 180:12:1 |
| | 43 | Control I | 25 | 58 | — |
| | | Control II | 23 | 53 | — |
| | | Run 1 | 34 | 79 | 105:12:1 |
| | | Run 2 | 34 | 79 | 144:12:1 |
| | | Run 3 | 40 | 93 | 180:12:1 |
| | 64 | Control I | 32 | 50 | — |
| | | Control II | 29 | 45 | — |
| | | Run 1 | 42 | 66 | 105:12:1 |
| | | Run 2 | 40 | 63 | 144:12:1 |
| | | Run 3 | 47 | 73 | 180:12:1 |
| 50 | 21 | Control I | 13 | 62 | — |
| | | Control II | 13 | 62 | — |
| | | Run 1 | 18 | 86 | 105:12:1 |
| | | Run 2 | 20 | 95 | 144:12:1 |
| | | Run 3 | 18 | 86 | 180:12:1 |
| | 43 | Control I | 22 | 51 | — |
| | | Control II | 20 | 47 | — |
| | | Run 1 | 28 | 65 | 105:12:1 |
| | | Run 2 | 37 | 86 | 144:12:1 |
| | | Run 3 | 33 | 77 | 180:12:1 |
| | 64 | Control I | 27 | 42 | — |
| | | Control II | 25 | 39 | — |
| | | Run 1 | 30 | 47 | 105:12:1 |
| | | Run 2 | 37 | 58 | 144:12:1 |
| | | Run 3 | 47 | 73 | 180:12:1 |

*The calculated retention values in excess of 100% are assumed to be the consequence of uneven pump flow as discussed earlier.

It will be seen that the examples of processes according to the invention exhibited higher retention levels and enabled significantly higher loading levels to be achieved. Filler:starch AAE copolymer ratios of 144:12:1 and 180:12:1 (filler:starch ratios of 12:1 and 15:1) gave the best results.

The results of strength testing (burst factor, breaking length, stiffness, etc.) showed that the papers made according to the present process had satisfactory properties, although in some cases the results were not as good as the controls. The deterioration in paper properties compared with the control papers was considered to be acceptable, having regard to the very substantial benefits achieved in loading levels and filler retention. Opacity, bulk, roughness and brightness tests also showed that the papers made by the present process were satisfactory. Overall it was felt that filler:starch ratios of about 12:1 to 15:1 and a starch:AAE copolymer ratio of about 12:1 gave the best results.

EXAMPLE 2

This illustrates the use of the present process with an acid sizing system (rosin/alum) instead of the alkyl ketene dimer sizing system used in Example 1.

The procedure was generally as described in sections (a) to (c) and (f) of Example 1, except that the quantities of material used were as follows:

| | | |
|---|---|---|
| Fibre (same blend as in Example 1) | 15 kg | |
| AAE copolymer ("Percol 1597") for fibre treatment | 63 g | (used in 5% aqueous suspension) |
| Chalk | 17.3 kg | (used in 25% aqueous slurry) |
| AAE Copolymer ("Percol 1597") for chalk treatment | 120 g | (used in 5% aqueous suspension) |
| Anionic starch ("Solvitose C5") | 1.44 kg | (used in 5% aqueous suspension) |

The filler:starch:AAE copolymer ratio was 144:12:1 (filler:starch ratio of 12:1). 50% alum solution was added to the fibre in the machine chest and to the mixing box. The alum addition was such as to maintain a headbox pH of between 5 and 6, and the total quantity of alum added was 360 g. 105 g of rosin size ("Bumal" supplied by Tenneco-Malros Ltd. of Avonmouth, United Kingdom) were added at the mixing box.

The papers obtained were tested as described in section (f) of Example 1 and the results obtained are shown in Table 2 below, together with the corresponding results from Example 1 for comparison:

TABLE 2

| Target grammage ($g\ m^{-2}$) | Target filler addition % | Ash content (%) Ex. 2 | Ash content (%) Ex. 1 | One-pass Retention (%) Ex. 2 | One-pass Retention (%) Ex. 1 |
|---|---|---|---|---|---|
| 100 | 21 | 25 | 21 | 100+* | 100 |
| | 43 | 50 | 34 | 100+* | 79 |
| | 64 | 33 | 40 | 52 | 63 |
| 50 | 21 | 19 | 20 | 90 | 95 |
| | 43 | 33 | 37 | 77 | 86 |
| | 64 | 41 | 37 | 64 | 58 |

*Explanation as footnote to Table 1.

It will be seen that the results are generally comparable to those of Example 1.

EXAMPLE 3

This illustrates the addition of treated filler to treated fibre at a variety of different points in the stock preparation or approach flow system of the papermachine. The papermachine used was that described in section (c) of Example 1.

The fibre and filler treatments were carried out generally as described in sections (a) and (b) respectively of Example 1, except that the quantities of material used were as follows:

| | | |
|---|---|---|
| Fibre (same blend as in Example 1) | 28 kg | (treated in 4% aqueous suspension) |
| AAE copolymer ("Percol 1597") for fibre treatment | 117 g | (2.34 kg of 5% aqueous solution) |
| Chalk | 32.3 kg | (used in 25% aqueous slurry) |
| AAE Copolymer ("Percol 1597") for chalk treatment | 224 g | (4.48 kg of 5% aqueous solution) |
| Anionic starch ("Solvitose C5") | 2.7 kg | (used in 5% aqueous solution) |

The above quantities are such that the AAE copolymer fibre treatment level was about 0.4% based on the weight of dry fibre, the AAE copolymer chalk treatment level was 0.7% based on the weight of chalk and the starch chalk treatment level was 8.3% based on the weight of chalk. The filler:starch:AAE copolymer ratio was 144:12:1 (filler:starch ratio of 12:1).

The treated chalk slurry was added to the treated fibre suspension at various points so as to give two stocks in each case containing 43% and 64% chalk, based on the total weight of dry fibre and chalk present. The addition points were the mixing box, before and after the refiners, and the machine chest (on this particular pilot-scale machine the function of the refiners is primarily to mix the stock well, and it is normal for the stock to be pre-refined to the desired degree of wetness in a separate refining operation). The stock was diluted to papermaking consistency and alkyl ketene dimer sizing agent was added as described in Example 1. The stock was then made into 100 $g\ m^{-2}$ paper in the normal way, and the paper was tested as described in section (f) of Example 1.

It was found that addition just after a region of turbulence in the stock preparation or approach flow system gave the best results overall. The results were not wholly conclusive, in that a particular point of addition could give both relatively good and relatively poor results, depending on the paper property being measured. Nevertheless, the general conclusion can be drawn that there is no absolute critically as to the point of addition employed, and the routine experimentation can be employed to determine the optimum point of addition for a particular treating system and papermachine.

EXAMPLE 4

This illustrates the use of a wider range of filler:polymer ratios than was used in Example 1, and also the use of a retention aid in conventional manner in conjunction with the present process.

The procedure was generally as described in sections (a) to (c) and (f) of Example 1, except that the quantities of materials used were different, and the treated chalk suspension was added at the headbox rather than the machine chest. In each case the quantity of dry fibre used was 14 kg, the quantity of AAE copolymer ("Percol 1597") used to treat the fibre was 59 g (1.18 kg of 5% solution), or about 0.4% based on the weight of dry fibre, and the weight of chalk was 10 kg. The quantities of polymers used to treat the chalk were as follows:

| | X (kg) | Wt of AAE Copolymer (g) | % of AAE Copolymer * | Y (kg) | Wt of anionic starch (kg) | % of anionic starch* |
|---|---|---|---|---|---|---|
| Run 1 | 3.30 | 166.5 | 1.70 | 34.0 | 1.70 | 17.0 |
| Run 2 | 1.67 | 83.5 | 0.84 | 20.0 | 1.00 | 10.0 |
| Run 3 | 1.10 | 55.5 | 0.56 | 13.4 | 0.67 | 6.7 |
| Run 4 | 0.83 | 41.5 | 0.42 | 10.0 | 0.50 | 5.0 |

*based on weight of chalk in each case

The approximate weight ratios of filler:anionic starch:AA copolymer (and of filler:anionic starch) for Runs 1 to 4 were as follows:

| | | |
|---|---|---|
| Run 1 | 60:10:1 | (6:1) |
| Run 2 | 120:12:1 | (10:1) |
| Run 3 | 180:12:1 | (15:1) |
| Run 4 | 240:12:1 | (20:1) |

Each Run was duplicated, in one case with no retention aid present and in the other with an addition of anionic polyacrylamide retention aid ("Percol E24") at the mixing box at a level of 0.01% based on dry fibre.

A control was also run using the procedure generally according to Control I of Example 1, except that the amount of polyacrylamide flocculating agent added to the chalk slurry was 0.01%, based on the weight of dry chalk.

With a filler:starch:AAE copolymer ratio of 60:10:1 (Run 1), runnability and paper formation was poor, owing to formation of very large flocs, and no 50 g $m^{-2}$ paper was obtained. 100 g $m^{-2}$ paper was however obtainable at this filler:starch:AAE copolymer ratio, although only at target filler additions of 21% and 43%. This suggested that a point of addition further back in the stock approach flow system may be desirable for filler:starch:AAE copolymer ratios of this order.

The results of ash contents and calculated retention values obtained for 100 g $m^{-2}$ and 50 g $m^{-2}$ papers are set out in Tables 4*a* and 4*b* respectively below.

TABLE 4a

| Target filler addition (%) | Making | (100 g $m^{-2}$) Retention aid (X = present) | Ash content (%) | One-pass retention (%) | Filler: starch: AAE copolymer ratio |
|---|---|---|---|---|---|
| 21 | Control | | 10 | 48 | — |
| | | X | 13 | 61 | |
| | Run 1 | | 17 | 81 | 60:10:1 |
| | | X | 18 | 86 | |
| | Run 2 | | 11 | 52 | |
| | | X | 11 | 52 | 120:12:1 |
| | Run 3 | | 17 | 81 | 180:12:1 |
| | | X | 16 | 76 | |
| | Run 4 | | 19 | 90 | 240:12:1 |
| | | X | 24 | 100+* | |
| 43 | Control | | 23 | 53 | — |
| | | X | 30 | 69 | |
| | Run 1 | | 18 | 42 | 60:10:1 |
| | | X | 19 | 43 | |
| | Run 2 | | 15 | 35 | 120:12:1 |
| | | X | 14 | 33 | |
| | Run 3 | | 21 | 49 | 180:12:1 |
| | | X | 22 | 51 | |
| | Run 4 | | 27 | 63 | 240:12:1 |
| | | X | 27 | 63 | |
| 64 | Control | | 30 | 47 | — |
| | | X | 41 | 65 | |
| | Run 1 | | — | — | 60:10:1 |
| | | X | — | — | |

TABLE 4a-continued

| Target filler addition (%) | Making | (100 g $m^{-2}$) Retention aid (X = present) | Ash content (%) | One-pass retention (%) | Filler: starch: AAE copolymer ratio |
|---|---|---|---|---|---|
| | Run 2 | | 30 | 47 | 120:12:1 |
| | | X | 30 | 47 | |
| | Run 3 | | 33 | 52 | 180:12:1 |
| | | X | 31 | 48 | |
| | Run 4 | | 38 | 59 | 240:12:1 |
| | | X | 38 | 59 | |

*Explanation as footnote to Table 1

TABLE 4b

| Target filler addition (%) | Making | (50 g $m^{-2}$) Retention aid (X = present) | Ash-content (%) | One-pass retention (%) | Filler: starch: AAE copolymer ratio |
|---|---|---|---|---|---|
| 21 | Control | | 7 | 31 | — |
| | | X | 11 | 54 | |
| | Run 1 | | — | — | 60:10:1 |
| | | X | — | — | |
| | Run 2 | | 12 | 57 | 120:12:1 |
| | | X | 12 | 57 | |
| | Run 3 | | 21 | 100+* | 180:12:1 |
| | | X | 24 | 100+* | |
| | Run 4 | | 22 | 100+* | 240:12:1 |
| | | X | 23 | 100+* | |
| 43 | Control | | 18 | 42 | — |
| | | X | 26 | 60 | |
| | Run 1 | | — | — | 60:10:1 |
| | | X | — | — | |
| | Run 2 | | 10 | 23 | 120:12:1 |
| | | X | 9 | 21 | |
| | Run 3 | | 26 | 60 | 180:12:1 |
| | | X | 26 | 60 | |
| | Run 4 | | 26 | 60 | 240:12:1 |
| | | X | 27 | 63 | |
| 64 | Control | | 24 | 38 | — |
| | | X | 37 | 58 | |
| | Run 1 | | — | — | 60:10:1 |
| | | X | — | — | |
| | Run 2 | | 26 | 41 | 120:12:1 |
| | | X | 25 | 39 | |
| | Run 3 | | 35 | 55 | 180:12:1 |
| | | X | 35 | 55 | |
| | Run 4 | | 38 | 59 | 240:12:1 |
| | | X | 38 | 59 | |

*Explanation as footnote to Table 1

It will be seen that in general, a filler:starch:AAE copolymer ratio of 240:12:1 gave the highest loading levels and retention values followed by a ratio of 180:12:1. The use of retention aid did not significantly affect loading levels or retention values except in the case of the control.

The results of the strength and other tests carried out gave results similar to those described in Example 1, and similar conclusions can be drawn. Filler:starch:AAE copolymer ratios of 240:12:1 and 180:12:1 gave the best strength results. The use of a retention aid did not appear to affect strength properties significantly.

EXAMPLE 5

This illustrates the use of a range of different levels of polymer treatment of fibre, and also the addition of treated filler at the fan pump of a papermachine, rather than at any of the addition points used in the previous examples. The papermachine used was an experimental machine of about 38 cm deckle, and had no drying capability. It was therefore necessary to stop the machine at intervals to remove the wet web formed for drying on a heated drum.

(a) Fibre treatment

An approximately 2% fibre suspension (same blend as in Example 1) was prepared in a graduated mixing tank. A proportion of this was then used untreated as described in step (c) below, in order to provide a control. When the control run was complete, a 50% solution of AAE copolymer ("Percol 1597") was added so as to give an approximate addition level, based on dry copolymer to dry fibre of 0.2% and paper was made. More copolymer solution was then added so as to raise the copolymer addition level to 0.4%, and more paper was made. This procedure was repeated twice more at addition levels of 0.7% and 0.9%.

(b) Filler treatment 50 kg of chalk were slurried in 150 kg water, and 694 g of a 50% solids content solution of AAE copolymer ("Percol 1597") in 10 kg water were added, giving an AAE copolymer level of 0.69% based on the weight of chalk present (dry weight of AAE copolymer was 347 g). 4.2 kg of dry anionic starch ("Solvitose C5") were added, giving a starch level of 8.4% based on the weight of chalk, and the total volume of the resulting mixture was made up to 250 l with more water.

(c) Mixing of filler and fibre suspensions/papermaking

The treated chalk slurry was added to the fibre suspensions from step (a) above at the fan pump of the papermachine, so as to give a target chalk content of about 64%, based on the total weight of fibre and chalk The stock was then diluted to papermaking consistency and drained on the wire of the papermachine, and the resulting web was dried and tested for ash content, burst factor and breaking length. The actual (as opposed to the target) chalk content of the stock in the headbox was also measured. The chalk and ash contents and the calculated retention values obtained are set out in Table 5 below:

TABLE 5

| AAE copolymer level (%) | Chalk content of stock (%) | Ash content (%) | One-pass retention (%) |
|---|---|---|---|
| 0 (Control) | 77 | 12 | 16 |
| 0.2 | 71 | 33 | 47 |
| 0.4 | 65 | 33 | 51 |
| 0.7 | 65 | 21 | 32 |
| 0.9 | 59 | 18 | 31 |

It will be seen that in all cases, treatment of the fibre gave much higher ash contents and retention values than the control with filler treatment alone. The best values were obtained with a 0.4% addition of AAE copolymer on fibre.

Treatment of the fibre also gave rise to improved burst and breaking length values, except in the case of the 0.9% addition level. The best values were again obtained with a 0.4% AAE copolymer addition.

EXAMPLE 6

This illustrates the effect of different positions of filler addition (fan pump and machine chest) at a range of filler addition levels and a constant level of AAE copolymer treatment of fibre (0.7% based on fibre). The fibre and filler treatments, the papermachine used, and the test measurements carried out were as described in Example 5.

The results obtained are set out in Table 6 below:

TABLE 6

| Point of chalk addition | Chalk content of stock (%) | Ash content (%) | One-pass retention (%) |
|---|---|---|---|
| Fan pump | 33 | 20 | 61 |
| | 43 | 30 | 70 |
| | 56 | 21 | 38 |
| Machine chest | 28 | 14 | 50 |
| | 39 | 13 | 33 |
| | 50 | 18 | 36 |

It will be seen that higher ash contents and retention values were achieved with fan pump addition. Direct comparison of strength values is problematical in view of the different ash levels involved.

EXAMPLE 7

This illustrates a process in which the fibre is treated with an anionic polymer and the filler is treated first with anionic polymer and then with cationic polymer (i.e. the reverse of the arrangement in the previous Examples).

(a) Fibre treatment

An approximately 2% fibre suspension (same blend as in Example 1) was prepared and a 0.5% solution of anionic polyacrylamide (Percol E24) was added to this suspension with stirring in an amount such as to give a polyacrylamide level of about 0.4%, based on weight of dry fibre.

(b) Filler treatment 50 kg of chalk were slurried in 150 kg water and a solution of 347 g of anionic polyacrylamide ("Percol E24") in 69 kg water was added, giving a polyacrylamide level of about 0.7%, based on the weight of chalk present. 4.2 kg of dry cationic starch ("Amisol 5906") were added, giving a starch level of 8.4%, based on the weight of chalk, and the total volume of the resulting mixture was made up to 250 l with more water.

(c) Mixing of filler and fibre suspensions/papermaking

The treated chalk slurry was added to the treated fibre suspension at a range of filler addition levels at al either the fan pump or machine chest of the experiment papermachine described in Example 5, after which the ed stock was diluted to papermaking consistency and drain to form a paper web. Test measurements were carried out as described in Example 5.

The results obtained are set out in Table 7 below:

TABLE 7

| Point of chalk addition | Chalk content of stock (%) | Ash content (%) | One-pass retention (%) |
|---|---|---|---|
| Fan pump | 37 | 33 | 89 |
| | 49 | 33 | 67 |
| | 61 | 35 | 57 |
| Machine chest | 35 | 8 | 23 |
| | 47 | 12 | 25 |
| | 53 | 22 | 42 |

It will be seen that as in Example 6, higher ash contents and retention values were achieved with fan pump addition.

EXAMPLE 8

This illustrates the use of the process described in Example 7 on a pilot-scale papermachine, rather than on an experimental papermachine with no drying facilities. The use of a larger papermachine with proper drying facilities affords a much more reliable indication of the inherent workability of the process and of the characteristics of the paper obtained. A repeat run using kaolin instead of chalk and a control run using known technology were also carried out. The ratio of filler:cationic starch:anionic polyacrylamide was 144:12:1.

(a) Fibre treatment (a) A 4% aqueous fibre suspension containing 21 kg of fibre on a dry basis was prepared (the fibre used was the same blend as described in Example 1). 17.7 kg of a 0.5% aqueous solution of an anionic polyacrylamide ("Percol E24") were added to the fibre suspension with stirring. The polyacrylamide content of the suspension was 88.5 g, or about 0.4% based on the weight of fibre present.

(b) Filler treatment 13 kg of chalk were slurried in 47 kg water, and 18.2 kg of 0.5% anionic polyacrylamide solution ("Percol E24") were added with stirring. This gave a polyacrylamide content of 91 g, or 0.7% based on the weight of chalk. 21.6 kg of 5% cationic starch solution ("Amisol 5906") were added with further stirring. The cationic starch addition on a dry basis was 1.08 kg, or 8.3% based on the weight of chalk.

(c) Mixing of filler and fibre suspensions/papermaking

The treated chalk slurry was added to the fibre suspension, at a position in the approach flow system after the refiners, in amounts intended to give chalk levels of about 15%, 30% and 45%, based on the total weight of fibre and chalk, after which the treated fibre suspension was diluted to papermaking consistency. Alkyl ketene dimer sizing agent ("Aquapel 2") was added at the mixing box at a level of 0.02%, based on the total solid material present. The various stocks were then drained to produce paper webs of target grammage 100 g $m^{-2}$ and 50 g $m^{-2}$ in the normal way. A 5% solution of solubilized starch ("Amisol 5592") was applied in each case by means of a size press on the papermachine. The pick-up was such as to produce a solubilized starch content of approximately 5% in the final paper web, based on the fibre content of the web. No 50 g $m^{-2}$ paper was made at a target chalk loading of 45% or a target kaolin loading of 15%.

(d) Use of kaolin instead of chalk

The procedure of steps (a) to (c) above was repeated using kaolin as a weight for weight replacement for chalk and utilising rosin/alum sizing instead of alkyl ketene dimer sizing. This involved the addition of 420 g alum and 335 g of 44% solids content rosin size ("Bumal") to the machine chest.

(e) Control

The process used was generally as disclosed in the article by Lindström and Kolseth referred to earlier. This process was chosen for the control as being a process which has attracted considerable attention in the paper industry and which is thought to represent one of the most interesting of the prior art processes.

A 4% fibre suspension containing 21 kg dry fibre (same blend as Example 1) was prepared, and the following additions were made to it:-

(i) a chalk slurry, made by dispersing 10 kg chalk in 67 kg water, at a position prior to the refiners, in amounts such as to give target chalk contents of 15%, 30% and 45% chalk, based on total weight of fibre and chalk.

(ii) 17.6 kg of a 5% solution of cationic starch ("Amisol 5906") containing 880 g of starch (4.2% based on weight of dry fibre) at a position after the refiners;

(iii) 12.6 kg of a 0.5% solution of anionic polyacrylamide containing 63 g of polyacrylamide (0.3% based on weight of dry fibre) at the mixing box; and (iv) alkyl ketene dimer sizing agent ("Aquapel 2") at a level of 0.02%, based on total weight of solids present, at the mixing box.

The procedure was then repeated using kaolin as a weight for weight replacement for chalk, and rosin/alum sizing instead of alkyl ketene dimer sizing (420 g alum and 335 g of 44% solids content rosin size ("Bumal") added to the machine chest).

No 50 g $m^{-2}$ control paper was made at a target loading of 45% for either chalk or clay.

(f) Results obtained

The papers obtained were subjected to a range of standard tests including ash content, burst, stiffness (Taber) and breaking length.

The burst values were converted to "burst factor" values according to the following formula:-

$$\text{Burst factor} = \frac{\text{burst}}{\text{grammage}} \ (\text{kPam}^2\text{g}^{-1})$$

The stiffness values were converted to "specific bending modulus" values according to the following formulae:

$$\text{Specific bending modulus} = \frac{\text{Taber stiffness}}{\text{grammage (thickness)}^2} \ (\text{unitless})$$

The purpose of these conversions was to compensate for variations in grammage and thickness of the sheet.

The results obtained are shown in Table 8 below:-

TABLE 8

| Target loading (%) | I/C * | Ash Content (%) | One-pass retention (%) | specific bending modulus $\times 10^{-6}$ (MD) | Burst factor ($kPam^2g^{-1}$) | Breaking length (km) (MD) |
|---|---|---|---|---|---|---|
| | | | Chalk - 50 g $m^{-2}$ | | | |
| 15 | I | 14 | 93 | 2.2 | 3.7 | 8.2 |
| | C | 20 | 100+** | 1.2 | 3.0 | 5.1 |
| 30 | I | 28 | 93 | 2.6 | 3.1 | 6.7 |
| | C | 27 | 90 | 1.7 | 1.8 | 4.0 |
| | | | Chalk - 100 g $m^{-2}$ | | | |
| 15 | I | 14 | 93 | 2.4 | 4.0 | 6.9 |
| | C | 10 | 67 | 2.6 | 3.2 | 6.0 |
| 30 | I | 25 | 83 | 2.4 | 3.6 | 7.9 |
| | C | 20 | 67 | 2.4 | 2.3 | 4.7 |
| 45 | I | 41 | 91 | 2.1 | 3.2 | 6.6 |
| | C | 53 | 100+** | 2.1 | 1.4 | 2.9 |
| | | | Kaolin - 50 g $m^{-2}$ | | | |
| 15 | I | — | — | | | — |
| | C | 15 | 100 | 2.5 | 3.3 | 5.9 |
| 30 | I | 22 | 73 | 1.9 | 3.0 | 5.8 |
| | C | 28 | 93 | 1.9 | 2.0 | 4.9 |
| 45 | I | 32 | 71 | 1.5 | 2.3 | 4.1 |
| | C | — | — | — | — | — |
| | | | Kaolin - 100 g $m^{-2}$ | | | |
| 15 | I | 12 | 80 | 2.6 | 3.8 | 7.1 |
| | C | 16 | 100+** | 2.9 | 3.4 | 6.5 |
| 30 | I | 23 | 77 | 2.1 | 3.0 | 5.8 |
| | C | 30 | 100 | 2.1 | 2.2 | 4.7 |
| 45 | I | 33 | 73 | 2.0 | 2.5 | 4.8 |
| | C | 47 | 100+** | 1.7 | 1.0 | 2.5 |

*I = Invention
C = Control
**Explanation of retention values more than 100% is as in footnote to Table 1.

It will be seen that the control run gave loading levels and retention values which in some cases were superior to those of this embodiment of the invention, and in other cases were inferior. No clear conclusions can be drawn from this data.

This embodiment of the invention did however demonstrate very significant benefits in terms of paper strength, as measured by burst factor values. Paper strength can be tested in a variety of ways, the most common of which are bursting strength, tearing resistance, tensile strength, folding endurance and stiffness. Of these, bursting strength is a particularly valuable indicator because it measures in one simple operation a composite of strength and toughness that correlates fairly well with many uses to which paper is put (see "Pulp & Paper—Chemistry & Chemical Technology", 3rd Edition edited by James P. Casey, at Volume 3, Chapter 21 by C. E. Brandon, pages 1779 and 1795).

The burst factor values quoted in Table 8 are best assessed when depicted graphically, as in FIGS. 1A–D of the accompanying drawings, on which the results from earlier control runs are also shown (it should be noted that the lines shown on these and subsequent graphs merely connect the plotted points and are not necessarily lines of best fit). It will be seen that significantly higher burst values were obtained at a given chalk loading level, for all chalk loading levels, and that the improvement generally became more pronounced at higher loading levels. This is of particular commercial importance. Whilst benefits were also obtained with kaolin, the improvements were less pronounced.

The specific bending modulus values obtained with this embodiment of the invention were generally comparable or somewhat worse than control. In the latter case, the deterioration was not so significant as to outweigh the benefits observed in other areas.

The breaking length values obtained were significantly higher than those of the control (and also of the earlier controls, which gave values similar to those of the Example 8 control).

EXAMPLE 9

This illustrates a process of the kind generally described in Example 1 but using kaolin as well as chalk. The quantities of material used were such as to give a filler:anionic starch:AAE copolymer ratio of 144:12:1.

(a) Fibre treatment

A 4% fibre suspension containing 21 kg of fibre on a dry basis was prepared (the fibre used was the same blend as described in Example 1). 17.7 kg of a 0.5% solution of AAE copolymer ("Percol 1597") were added to the fibre suspension with stirring. The AAE copolymer content of the suspension was 88 g or about 0.4% based on the weight of fibre present.

(b) Filler treatment 10 kg of chalk were slurried in 37 kg water and this slurry was mixed with stirring with 14 kg of a 0.5% solution of AAE copolymer ("Percol 1597"). The AAE copolymer content of the mixture was 70 g or 0.7% based on the weight of chalk. 16.6 kg of a 5% solution of anionic starch ("Solvitose C5") were added, with further stirring. The anionic starch content of the mixture was 0.83 kg or 8.3% based on the weight of chalk.

(c) Mixing of filler and fibre suspensions/papermaking

The procedure was as described in section (c) of Example 8.

(d) Use of kaolin intead of chalk

The procedure of steps (a) to (c) above was repeated using kaolin as a weight for weight replacement for chalk and utilising rosin/alum sizing as described in section (d) of Example 8 instead of alkyl ketene dimer sizing.

The results obtained are set out in Table 9 below:

TABLE 9

| Target loading (%) | Ash Content (%) | One-pass retention (%) | Specific bending modulus $\times 10^{-6}$ (MD) | Burst factor ($KPam^2g^{-1}$) | Breaking length (km) (MD) |
|---|---|---|---|---|---|
| | | Chalk - 50 g $m^{-2}$ | | | |
| 15 | 14 | 93 | 2.0 | 2.2 | 4.8 |
| 30 | 26 | 87 | 1.3 | 1.6 | 3.3 |
| 45 | 35 | 78 | 1.5 | 1.7 | 3.0 |
| | | Chalk - 100 g $m^{-2}$ | | | |
| 15 | 15 | 100 | 2.1 | 2.3 | 4.6 |
| 30 | 26 | 87 | 1.9 | 1.9 | 4.1 |
| 45 | 35 | 78 | 1.8 | 1.8 | 3.7 |
| | | Kaolin - 50 g $m^{-2}$ | | | |
| 15 | 12 | 80 | 2.3 | 2.8 | 6.0 |
| 30 | 22 | 73 | 1.6 | 1.9 | 4.0 |
| 45 | 32 | 71 | 0.9 | 1.1 | 3.4 |
| | | Kaolin - 100 g $m^{-2}$ | | | |
| 15 | 11 | 73 | 2.5 | 2.8 | 5.3 |
| 30 | 22 | 73 | 2.1 | 2.0 | 4.4 |
| 45 | 32 | 71 | 1.9 | 1.4 | 3.0 |

The burst factor, specific bending modulus and breaking length values obtained were generally comparable or somewhat worse than for the controls from previous Examples, (where a reasonable comparison can be made). The loading level and retention values were of the same general order as in Example 8.

EXAMPLE 10

This illustrates a process generally as described in Example 9 but with a different filler:anionic starch:AAE copolymer ratio (77:6:1 instead of 144:12:1).

The procedure was as described in Example 9 except that:-

(i) 10 kg of chalk or kaolin were slurried in 26 kg water;

(ii) 26 kg of 0.5% AAE copolymer solution were used for filler treatment in each case, giving an AAE copolymer content of 130 g (1.3% based on weight of chalk or kaolin); and (iii) 15.6 kg of 5% anionic starch solution ("Solvitose C5") were used for filler treatment in each case, giving an anionic starch content of 0.78 kg (7.8% based on weight of chalk or kaolin).

For the 50 g $m^{-2}$ target grammage kaolin-loaded paper, duplicate runs were carried out with addition of treated kaolin slurry before and after the refiners respectively. The results obtained are set out in Table 10 below:

TABLE 10

| Target loading (%) | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|
| | | Chalk - 50 g $m^{-2}$ | | | |
| 15 | 14 | 93 | 1.6 | 2.5 | 5.9 |
| 30 | 28 | 93 | 1.1 | 1.7 | 4.3 |
| 45 | 41 | 91 | 1.1 | 1.2 | 3.0 |
| | | Chalk - 100 g $m^{-2}$ | | | |
| 15 | 13 | 87 | 2.4 | 3.1 | 6.4 |
| 30 | 27 | 90 | 2.1 | 2.1 | 4.1 |

TABLE 10-continued

| Target loading (%) | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|
| 45 | 37 | 82 | 2.0 | 1.5 | 3.3 |
| | | Kaolin - 50 g $m^{-2}$ | | | |
| 15(a) | 12 | 80 | 1.6 | 2.8 | 6.8 |
| (b) | 11 | 73 | 2.0 | 2.9 | 7.1 |
| 30(a) | 23 | 77 | 1.7 | 2.1 | 5.2 |
| (b) | 20 | 67 | 1.6 | 2.3 | 5.5 |
| 45(a) | 33 | 73 | 1.9 | 1.6 | 4.2 |
| (b) | 19 | 42 | 1.9 | 2.6 | 6.0 |
| | | Kaolin - 100 g $m^{-2}$ | | | |
| 15 | 12 | 80 | 2.6 | 2.6 | 5.7 |
| 30 | 23 | 77 | 1.9 | 2.0 | 4.9 |
| 45 | 33 | 73 | 1.8 | 1.7 | 3.9 |

(a) and (b) = addition after and before refiners respectively.

The burst factor, specific bending modulus and breaking length values obtained were generally comparable or somewhat worse than for the controls. The loading level and retention values were generally slightly improved compared with Example 9.

EXAMPLE 11

This illustrates the use of a cationic starch to treat the fibre and the filler, followed in the case of the filler by a treatment with anionic polyacrylamide. The ratio of filler:cationic starch:anionic polyacrylamide was 333:14:1.

(a) Fibre treatment

A 4% aqueous fibre suspension containing 21 kg of fibre on a dry basis was prepared (the fibre used was the same blend as described in Example 1). 11.75 kg of a 5% solution of cationic starch ("Amisol 5906") were added with stirring, giving a cationic starch content of 0.59 kg (2.8% based on weight of fibre).

(b) Filler treatment 10 kg of chalk were slurried in 52 kg water, and 8.4 kg of a 5% solution of cationic starch ("Amisol 5906") were added with stirring. This gave a cationic starch content of 0.42 kg (4.2% based on the weight of chalk). 6 kg of a 0.5% anionic polyacrylamide solution ("Percol E24") were added with further stirring. This gave an anionic polyacrylamide content of 0.03 kg (0.3% based on the weight of chalk).

(c) Mixing of filler and fibre suspensions/papermaking

The procedure was as described in section (c) of Example 8, except that only 100 g $m^{-2}$ paper was made. The runs were duplicated, with the treated filler being added before, instead of after, the refiners in the duplicate runs.

(d) Use of kaolin instead of chalk

The procedure of steps (a) to (c) above was repeated using kaolin as a weight for weight replacement for chalk, and utilizing rosin/alum sizing as described in section (d) of Example 8 instead of alkyl ketene dimer sizing.

The results obtained are set out in Table 11 below:

TABLE 11

| Target loading (%) | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|
| | | Chalk - 100 g $m^{-2}$ - addition before refiners | | | |
| 15 | 8 | 53 | 3.0 | 3.6 | 8.1 |
| 30 | 15 | 50 | 2.7 | 3.9 | 7.1 |
| | | Chalk - 100 g $m^{-2}$ - addition after refiners | | | |
| 15 | 10 | 67 | 2.9 | 4.2 | 9.1 |
| 30 | 18 | 60 | 3.1 | 3.7 | 7.9 |
| 45 | 25 | 56 | 2.6 | 3.5 | 8.4 |
| | | Kaolin - 100 g $m^{-2}$ - addition before refiners | | | |
| 15 | — | — | — | — | — |
| 30 | — | — | — | — | — |
| 45 | 28 | 62 | 2.5 | 2.7 | 7.1 |
| | | Kaolin - 100 g $m^{-2}$ addition after refiners | | | |
| 15 | 11 | 73 | 2.9 | 3.7 | 8.0 |
| 30 | 21 | 70 | 3.0 | 3.4 | 7.1 |
| 45 | 33 | 73 | 2.4 | 2.4 | 5.3 |

Figure 2B:
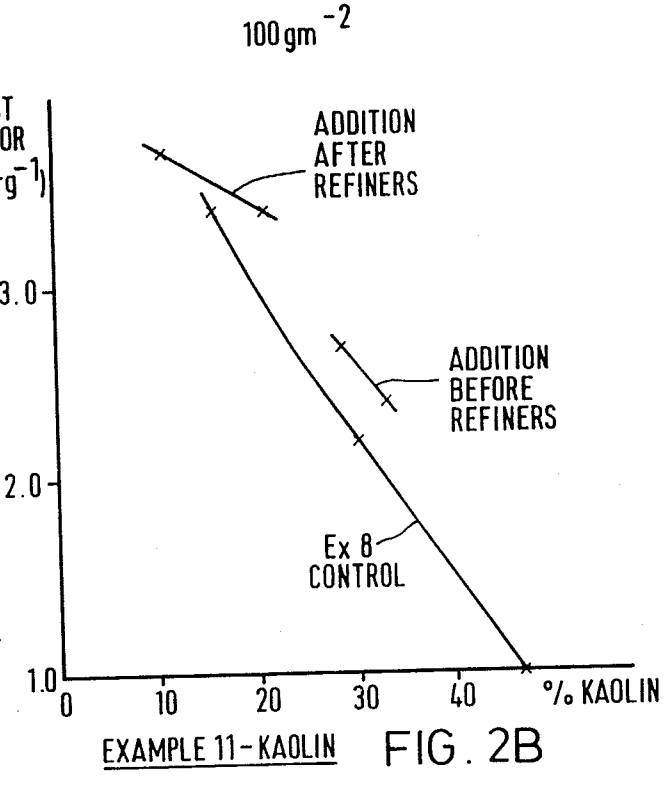
FIGS. 2A and 2B are graphical illustrations of the results obtained from Example 11 relating to burst values.
Figure 2A:
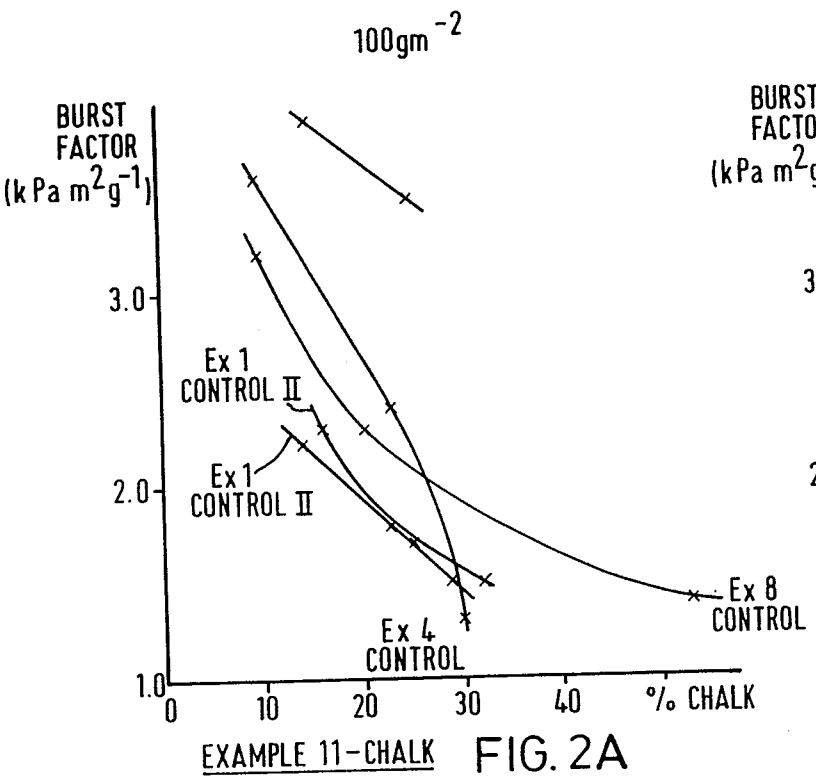

The burst factor values obtained are depicted on FIGS. 2A and 2B of the accompanying drawings, and it will be seen that benefits were obtained compared with the controls, although these benefits were not as marked as in Example 8. Excellent breaking strength values were also obtained, and there was some improvement in specific bending modulus values compared with the controls. The loading level and retention values were in some cases relatively low, but it was noticed during the trial that the pump flow rates for the filler suspension were erratic, probably as a result of the viscosity of the suspension, and it is felt therefore that the calculated retention values (which assume a constant pump flow rate) may well be inaccurate. Addition of filler suspension after the refiners gave better results than addition before the refiners.

EXAMPLE 12

This illustrates the use of a cationic polyacrylamide to treat the fibre and the filler, followed in the case of the filler by a treatment with anionic starch. The ratio of filler:anionic starch:cationic polyacrylamide was approximately 144:12:1 (the strictly calculated value is 143:12:1)

(a) Fibre treatment

A 4% aqueous fibre suspension containing 14 kg of fibre on a dry basis was prepared (the fibre used was the same blend as described in Example 1). 11.75 kg of a 0.5% solution of cationic polyacrylamide ("Percol 47" supplied by Allied Colloids Ltd.) were added with stirring, giving a cationic polyacrylamide content of 59 g (about 0.4% based on weight of fibre).

(b) Filler treatment 10 kg of chalk was slurried in 35 kg water, and 14 kg of a 0.5% solution of cationic polyacrylamide ("Percol 47") were added with stirring. This gave a cationic polyacrylamide content of 70 g (0.7% based on the weight of chalk). 16.6 kg of 5% anionic starch solution ("Solvitose C5") were added with further stirring. This gave an anionic starch content of 0.83 kg (8.3% based on the weight of chalk).

(c) Mixing of filler and fibre suspensions/papermaking

The procedure was as described in section (c) of Example 8, except that only 100 g $m^{-2}$ paper was made and that the target filler additions were different. The target chalk additions were 25%, 33% and 46% and the target kaolin additions were 24%, 35%, 49%, 60%, 68% and 72%. All kaolin additions were made before the refiner, and chalk additions were made both before and after the refiners as described in Example 12.

(d) Use of kaolin instead of chalk

The procedure of steps (a) to (c) above was repeated using kaolin as a weight for weight replacement for chalk, except that the treated kaolin suspension was added to the fibre at different addition levels, and that rosin/alum sizing as described in section (d) of Example 8 was utilized instead of alkyl ketene dimer sizing. The kaolin addition levels were such as to give kaolin contents of 24%, 35%, 49%, 60%, 68% and 72%.

The results obtained are set out in Table 12 below:-

TABLE 12

| Target loading (%) | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|
| | | Chalk - 100 g $m^{-2}$ | | | |
| 25(a) | 23 | 92 | 2.0 | 3.0 | 6.2 |
| 25(b) | 21 | 84 | 2.5 | 3.4 | 7.4 |
| 33(a) | 32 | 97 | 1.8 | 2.8 | 5.5 |
| 33(b) | 29 | 88 | 2.4 | 3.0 | 6.3 |
| 46(a) | 41 | 89 | 1.7 | 2.5 | 4.8 |
| 46(b) | 38 | 83 | 1.9 | 2.3 | 5.0 |
| | | Kaolin - 100 g $m^{-2}$ - addition before refiners | | | |
| 24 | 18 | 75 | 2.1 | 2.7 | 5.4 |
| 35 | 25 | 71 | 1.8 | 2.4 | 4.8 |
| 49 | 52 | 100+* | 1.9 | 2.3 | 3.9 |
| 60 | 41 | 68 | 1.7 | 1.9 | 3.7 |
| 68 | 45 | 66 | 1.8 | 1.7 | 3.8 |
| 72 | 47 | 65 | 1.6 | 1.5 | 3.6 |

*Explanation as previously
N.B. (a) and (b) = addition after and before refiners respectively.

Figure 3B:
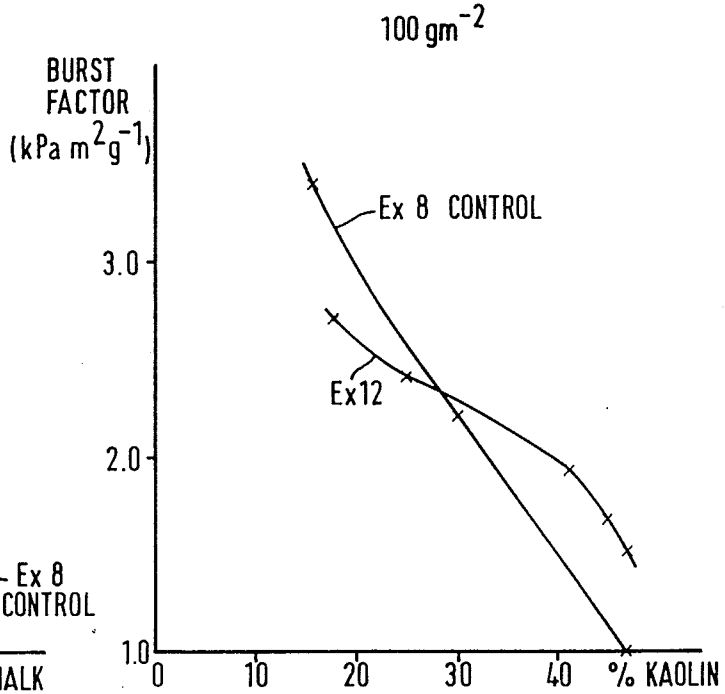
FIGS. 3A and 3B are graphical illustrations of the results obtained from Example 12 relating to burst values.
Figure 3A:
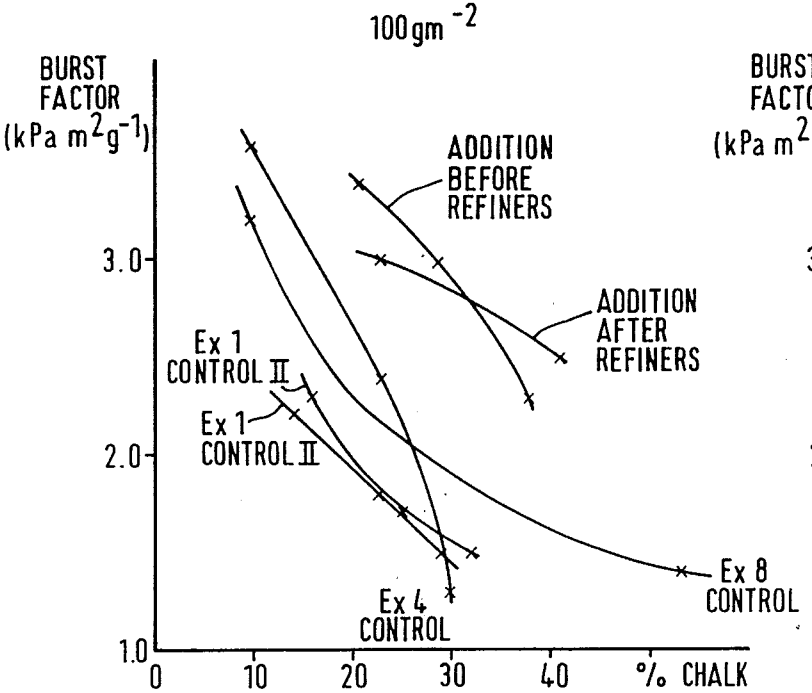

The burst factor values obtained are depicted on FIGS. 3A and 3B of the accompanying drawings, and it will be seen that benefits were obtained compared with the controls. Improved breaking lengths were also obtained, but specific bending modulus values showed no improvement or a small deterioration. No clear preference emerged for addition of chalk slurry before or after the refiners so far as strength properties are concerned. Loading level and retention values for chalk were high, but much lower for kaolin. As with the previous Example, filler suspension pump flow rates were observed to be erratic, and the retention values may therefore be unreliable. Better loading level and retention values were obtained for chalk when the chalk addition took place after the refiners.

EXAMPLE 13

This illustrates the use of a cationic polyamine for treating the fibre and for initial treatment of the filler, and of a different anionic starch from that used in previous examples for further filler treatment.

(a) Filler treatment 9 g of a 2% solution of a polyamine of molecular weight about 200,000 ("Accurac 57" supplied by American Cyanamid) were added with stirring to a slurry of 27 g chalk in 81 g water. 75 g of a 3% solution of an anionic starch ("Flo-Kote 64", an anionic maize starch supplied by Laing Laing-National limited, of Manchester, United Kingdom) was added with stirring to the chalk slurry.

(b) Fibre treatment 1.5 g of 2% polyamine solution ("Accurac 57") were added with stirring to 383 g of an aqueous fibre suspension containing 18 g fibre on a dry basis. A further 250 g water were then added.

(c) Mixing of filler and fibre suspensions/papermaking/testing

The treated filler and fibre suspensions were mixed, with stirring, and a further 3 kg water were added. The resulting stock was then used to produce a square handsheet of 50 g $m^{-2}$ target grammage, using a laboratory sheet making machine. The ash content and burst factor values for the resulting sheet were then determined.

(d) Further runs

The procedure was then repeated using a range of different quantities of filler and treating polymers. Controls with certain of the filler or fibre treatment stages omitted were also run.

The quantities of treating polymers used, and the results obtained are set out in Table 13 below:

TABLE 13

| Run No. C = control | Wt. of 2% polyamine soln. used for filler treatment (g) | Wt. of 3% anionic starch soln. (g) | Wt. of 2% polyamine soln. used for fibre treatment (g) | Ash content (%) | filler retention (%) | Burst factor (kPa $m^2g^{-1}$) |
|---|---|---|---|---|---|---|
| 1 | 2 | 75 | 1.5 | 20 | 33 | 2.1 |
| 2 | 5 | 75 | 1.5 | 20 | 33 | 2.4 |
| 3 | 9 | 75 | 1.5 | 23 | 38 | 2.7 |
| 4* | 11 | 75 | 1.5 | 29 | 54 | 2.6 |
| 5* | 13 | 75 | 1.5 | 31 | 57 | 3.1 |
| 6* | 15 | 75 | 1.5 | 30 | 56 | 2.6 |
| 7* | 18 | 75 | 1.5 | 25 | 46 | 2.9 |
| C.1 | 9 | — | 1.5 | 42 | 70 | 0.8 |
| C.2 | — | 75 | — | 21 | 35 | 1.7 |

*For runs 4 to 7, the 2% polyamine solution was added to 415 g of aqueous fibre suspension containing 18 g fibre on a dry basis, and only 150 g water were added subsequently.

It will be seen that although Control 1 enabled a high loading level and retention value to be achieved, the burst factor values for the paper obtained were low. The Control 2 paper had the same order of ash content as Runs 1 to 3, but had a very much lower burst factor value.

EXAMPLE 14

This illustrates the use of a different anionic starch in a process otherwise similar to that of Example 13, except that different quantities of treating polymers were used. The anionic starch was a phosphate ester of hydrolysed potato starch supplied as "Nylgum A160" by H. Helias & Co. Ware, United Kingdom), and was used in 3% aqueous solution.

The quantities of treating polymers used, and the results obtained are set out in Table 14 below:-

TABLE 14

| Run No. C = control | Wt. of 2% polyamine soln. used for filler treatment (g) | Wt. of 3% anionic starch soln. (g) | Wt. of 2% polyamine soln. used for fibre treatment (g) | Ash content (%) | Filler retention (%) | Burst factor (kPa $m^2g^{-1}$) |
|---|---|---|---|---|---|---|
| 1 | 2 | 60 | 1.5 | 21 | 35 | 2.2 |
| 2 | 5 | 60 | 1.5 | 20 | 33 | 2.4 |
| 3 | 7 | 60 | 1.5 | 32 | 53 | 2.6 |
| 4 | 8 | 60 | 1.5 | 31 | 52 | 2.6 |
| 5 | 9 | 60 | 1.5 | 38 | 63 | 2.4 |

TABLE 14-continued

| Run No. C = control | Wt. of 2% polyamine soln. used for filler treatment (g) | Wt. of 3% anionic starch soln. (g) | Wt. of 2% polyamine soln. used for fibre treatment (g) | Ash content (%) | Filler retention (%) | Burst factor (kPa $m^2g^{-1}$) |
|---|---|---|---|---|---|---|
| 6 | 11 | 60 | 1.5 | 46 | 77 | 1.6 |
| C.1 | — | 60 | — | 24 | 40 | 1.7 |
| C.2 | 7 | — | 1.5 | 45 | 75 | 0.7 |
| C.3* | 7 | — | 1.5 | 40 | 71 | 0.9 |
| C.4* | 7 | — | 1.5 | 37 | 72 | 1.0 |

*23 g and 19 g of chalk were used in Controls 3 and 4 respectively, instead of the 27 g used in other runs and controls.

It will be seen that although controls 2 and 4 enabled high loading levels and retention values to be achieved, the burst factor values for the papers obtained were very low, compared with the papers from runs 5 and 6 where comparably high loading levels were achieved. Control 1 gave a paper with an ash content well below that of the papers obtained in runs 3 and 4, but it had a much lower burst factor value.

When a similar series of experiments was repeated with a similar polyamine of weaker cationic charge ("Accurac 67"), no significant effect on ash content and burst factor values was observed compared with the controls. This demonstrates that strength of charge can significantly affect the performance of a particular polymer in the present process, and that it should be taken into account when selecting treating polymers for use in the present process.

EXAMPLE 15

This illustrates the use of a different anionic starch from that used in previous Examples.

(a) Filler treatment 4 g of a 3% aqueous solution of AAE copolymer ("Magnafloc 1597" supplied by Allied Colloids Ltd. and believed to be chemically the same as "Percol 1597") were added with stirring to a slurry of 27 g chalk in 81 g water. 85 g of a 3% aqueous solution of anionic starch ("Retabond AP", a potato starch phosphate ester supplied by Tunnel Avebe) were added with stirring to the chalk slurry.

(b) Fibre treatment

A suspension of 18 g fibres on a dry basis in 655 g water was also prepared, and 3 g of 3% AAE copolymer solution ("Magnafloc 1597") were added.

(c) Mixing of filler and fibre suspensions/papermaking/testing

This was as described in Example 13.

(d) Further runs

These were carried out on the same general basis as outlined in Example 13. The quantities of material used, and the results obtained are set out in Table 15 below:

TABLE 15

| Run No. C = control | Wt. of 3% AAE copolymer soln. for filler treatment (g) | Wt. of 3% anionic starch soln. (g) | Wt. of 3% AAE copolymer soln. for fibre treatment | Ash content (%) | Filler retention (%) | Burst factor (kPa $m^2g^{-1}$) |
|---|---|---|---|---|---|---|
| 1 | 4 | 85 | 3 | 19 | 32 | 2.3 |
| 2 | 8 | 85 | 3 | 38 | 63 | 2.2 |
| 3 | 5 | 85 | 3 | 30 | 50 | 3.3 |
| 4 | 7 | 85 | 3 | 42 | 70 | 2.4 |
| 5 | 9 | 85 | 3 | 48 | 80 | 2.0 |
| C. 1 | 7 | — | 2 | 30 | 50 | 0.9 |
| C. 2 | — | 85 | — | 19 | 32 | 1.3 |
| C. 3 | 7 | — | 3 | 29 | 48 | 1.5 |
| C. 4* | — | 85 | — | 32 | 49 | 1.5 |

*34 g of chalk was used in Control 4.

It will be seen that for comparable ash contents, papers made according to the present process had much higher burst factor values than the control papers. Higher ash contents and retention values were also achievable with the present process.

EXAMPLE 16

This Example is similar to the previous Example, but illustrates the effect of varying the amount of AAE copolymer used to treat the fibre.

The procedure was otherwise generally as in Example 15, except that 18 g chalk were used instead of the 27 g of Example 15. The other quantities of material used, and the results obtained are set out in Table 16 below:

TABLE 16

| Run No. C = control | Wt. of 3% AAE copolymer soln. for filler treatment (g) | Wt. of 3% anionic starch soln. (g) | Wt. of 3% AAE copolymer soln. for fibre treatment (g) | Ash content (%) | Filler Retention (%) | Burst factor (kPa $m^2g^{-1}$ |
|---|---|---|---|---|---|---|
| 1 | 5.8 | 69.2 | 1.5 | 30 | 60 | 3.2 |
| 2 | 5.8 | 69.2 | 3.0 | 32 | 64 | 3.1 |
| 3 | 5.8 | 69.2 | 4.5 | 33 | 66 | 3.3 |
| 4 | 5.8 | 69.2 | 6.0 | 35 | 70 | 3.2 |
| 5 | 5.8 | 69.2 | 7.5 | 34 | 68 | 3.5 |
| C1 | 5.8 | 69.2 | — | 17 | 34 | 2.7 |

TABLE 16-continued

| Run No. C = control | Wt. of 3% AAE copolymer soln. for filler treatment (g) | Wt. of 3% anionic starch soln. (g) | Wt. of 3% AAE copolymer soln. for fibre treatment (g) | Ash content (%) | Filler Retention (%) | Burst factor (kPa $m^2g^{-1}$ |
|---|---|---|---|---|---|---|
| C2 | 11.8 | 69.2 | — | 36 | 72 | 2.4 |

It will be seen that although Control 2 gave a paper with a high loading level, its burst factor was much lower than the paper from Run 4 for which the ash content was comparable to that of the paper from Control 2. It will be seen also that increasing the level of fibre treatment did not have any unexpected effect on the ash contents and burst factor values obtained—there was merely a gradual increase in these values with increasing polymer level.

EXAMPLE 17

This illustrates the use of a DADMAC polymer as the cationic polymer and a gum (thought to be a polysaccharide) as the anionic polymer.

(a) Filler treatment 3 g of a 2% aqueous solution of quaternary ammonium polymer ("Alcostat 167" supplied by Allied Colloids Ltd.) were added with stirring to a slurry of 27 g chalk in 81 g water. 60 g of a 2% solution of an anionic modified locust bean gum were added with stirring to the chalk slurry.

(b) Fibre treatment

A suspension of 18 g fibres on a dry basis in 655 g water was also prepared, and 2 g of quaternary ammonium polymer ("Alcostat 167") were added.

(c) Mixing of filler and fibre suspensions/papermaking/testing

This was as described in Example 13.

(d) Further runs

These were carried out on the same general basis as outlined in Example 13.

The quantities of material used and the results obtained are set out in Table 17 below:

TABLE 17

| Run No. C = control | Wt. of 2% quat. ammonium polymer soln. for filler treatment (g) | Wt. of 3% anionic starch soln (g) | Wt. of 2% quat. ammonium polymer soln. for fibre treatment (g) | Ash content (%) | Filler retention (%) | Burst (kPa $m^2g^{-1}$) |
|---|---|---|---|---|---|---|
| 1 | 3 | 60 | 2 | 24 | 40 | 2.0 |
| 2 | 5 | 60 | 2 | 31 | 52 | 1.8 |
| 3 | 9 | 60 | 2 | 33 | 55 | 1.9 |
| C. 1 | — | 60 | — | 26 | 43 | 1.5 |

It will be seen that Runs 2 and 3 produced papers with higher ash contents and burst factor values than the control paper. Run 1 gave a paper with a slightly lower ash content than the control paper but a much higher burst factor value.

EXAMPLE 18

This illustrates the use of the present process with titanium dioxide as the filler.

The procedure and materials employed were generally as described in Example 16, with 18 g titanium dioxide being used in place of 18 g chalk. The other quantities of polymers used and the results obtained are set out in Table 18 below:

TABLE 18

| Run No. | Wt. of 3% AAE copolymer soln. for filler treatment (g) | Wt. of a 3% anionic starch soln. (g) | Wt. of 3% AAE copolymer soln. for fibre treatment (g) | Ash content (%) | Burst (kPa $m^2g^{-1}$) |
|---|---|---|---|---|---|
| 1 | 7 | 85 | 3 | 31 | 2.6 |
| 2 | 9 | 85 | 3 | 28 | 2.5 |
| 3 | 11 | 85 | 3 | 29 | 3.1 |
| 4 | 13 | 85 | 3 | 30 | 3.4 |
| 5 | 13 | 85 | 3 | 29 | 3.5 |

EXAMPLE 19

This further illustrates the use of the present process with titanium dioxide as the filler, and also includes a variant of the process in which the two polymers used to treat the fillers are mixed prior to contacting the filler.

The procedure and materials employed were generally as described in Example 18, except for the variant just referred to, which constituted the third Run, and except that in the second Run, only 10 g titanium dioxide was used instead of 18 g. Three controls were run, and in the third of these, the polymers used for filler treatment were mixed prior to contacting the filler. The quantities of polymers used and the results obtained are set out in Table 19 below:

TABLE 19

| Run No. (C = Control | Wt. of 3% AAE copolymer soln. for filler treatment (g) | Wt. of 3% anionic starch soln. (g) | Wt. of 3% AAE copolymer soln. for fibre treatment (g) | Ash content (%) | Burst factor (kPa $m^2g^{-1}$) |
|---|---|---|---|---|---|
| 1 | 7 | 85 | 3 | 33 | 2.3 |
| 2 | 7 | 85 | 3 | 25 | 3.3 |
| 3 | 7 | 85 | 3 | 33 | 2.6 |
| C1 | — | 85 | — | 30 | 1.9 |
| C2 | 7 | — | 3 | 27 | 1.0 |

TABLE 19-continued

| Run No. (C = Control | Wt. of 3% AAE copolymer soln. for filler treatment (g) | Wt. of 3% anionic starch soln. (g) | Wt. of 3% AAE copolymer soln. for fibre treatment (g) | Ash content (%) | Burst factor (kPa $m^2g^{-1}$) |
|---|---|---|---|---|---|
| C3 | 10 | 85 | — | 28 | 2.6 |

It will be seen that the papers made according to the invention were superior to the controls in burst factor values and/or in ash content levels.

EXAMPLE 20

This illustrates a range of process variants which may be utilised in practising the invention. These were as follows:

Run 1—Treatment of filler and fibre separately with cationic polymer solution followed by further treatment of the treated filler with anionic polymer solution before mixing of treated filler and treated fibre.

Run 2—As Run 1 except that the anionic polymer was used for further treatment of the treated fibre rather than of the treated filler.

Run 3—As Run 1 except that the cationic polymer and the anionic polymer solutions were mixed before being used to treat the filler rather than being used sequentially.

Run 4—As Run 2, except that the cationic polymer and anionic polymer solutions were mixed before being used to treat the fibre rather than being used sequentially.

Each run was carried out at target loading levels of 15%, 30%, 45% and 60%.

In each case the cationic polymer solution was a 3% solution of AAE copolymer ("Percol 1597"), the anionic polymer solution was a 3% solution of anionic starch ("Retabond AP"), the filler was chalk (used in the form of a slurry of 3.2 g chalk in 10 g water), and the fibre was treated when in the form of an aqueous slurry containing 18 g fibre on a dry basis at a consistency of about 4%. In Runs 1 and 3 at a 15% target loading, the fibre suspension was treated with 4.5 g of AAE copolymer solution, and the chalk slurry was treated with 1.0 g of AAE copolymer solution and 12 g of anionic starch solution. In Runs 2 and 4 at a 15% target loading, the treatment levels were reversed, i.e. the fibre suspension was treated with 1.0 g of AAE copolymer solution and 12 g of anionic starch solution, and the chalk slurry was treated with 4.5 g of AAE copolymer solution, so that the total quantity of treating polymers was the same in each of the four Runs. For the higher target loading levels, the quantities of AAE copolymer solution and anionic starch solution used to treat the chalk in Runs 1 and 3 and to treat the fibre in Runs 2 and 4 were increased proportionately i.e. twice the quantities were used for 30% target loading, three times for 45% target loading and four times for 60% target loading. The quantities of chalk slurry used were similarly multiplied. However the quantity of treating polymer used for the singly-treated material, i.e. the fibre in Runs 1 and 3, and the chalk in Runs 2 and 4, remained the same as stated above for 15% target loading. The treatment procedures employed in each case were broadly as described in the previous laboratory Examples, except that for Runs 2 to 4, they were varied in accordance with the description given earlier. After mixing the filler and fibre suspensions and stirring well, the volume of the mixture was made up to about 10 1 with tap water. Portions of the resulting stocks were further diluted to a consistency of about 0.03% and used to produce round handsheets, each weighing about 1 g, by means of a British Standard sheet machine.

The resulting handsheets were tested to determine ash content, burst factor and breaking length values. The results are set out in Table 20 below:

TABLE 20

| Target Loading (%) | Run No. | Ash Content (%) | Filler Retention (%) | Burst Factor (kPa $m^2g^{-1}$) | Breaking Length (km) |
|---|---|---|---|---|---|
| 15 | 1 | 8 | 53 | 4.6 | 6.8 |
| | 2 | 11 | 73 | 4.6 | 6.0 |
| | 3 | 13 | 87 | 4.6 | 5.6 |
| | 4 | 11 | 73 | 4.8 | 5.6 |
| 30 | 1 | 19 | 63 | 4.6 | 5.3 |
| | 2 | 16 | 53 | 4.5 | 5.3 |
| | 3 | 17 | 57 | 4.8 | 4.8 |
| | 4 | 21 | 70 | 4.1 | 5.1 |
| 45 | 1 | 25 | 56 | 4.2 | 5.0 |
| | 2 | 22 | 49 | 4.2 | 4.9 |
| | 3 | 21 | 47 | 4.3 | 5.5 |
| | 4 | 19 | 42 | 3.4 | 5.1 |
| 60 | 1 | 35 | 58 | 3.4 | 4.1 |
| | 2 | 30 | 50 | 3.7 | 4.3 |
| | 3 | 22 | 37 | 4.0 | 5.4 |
| | 4 | 23 | 38 | 2.9 | 3.9 |

It will be seen that the figures exhibit a certain amount of scatter, and that no clear pattern of performance as regards loading levels and retention values emerges in relation to the four different Run types at target loadings up to 45%. However, at 60% target loading, Runs 3 and 4 (in which the cationic and anionic polymers were mixed prior to being used to treat the filler or fibre) gave sharply reduced loading and retention values. Burst factor values were comparable for all Runs at loading levels of up to about 20%. Above this level, burst factor values fell dramatically for Run 4 papers, but not for Run 1 and Run 2 papers. Run 3 did not give rise to sufficiently high loading levels to enable conclusions to be drawn. Breaking length values were fairly directly related to loading levels for all Run 1 and Run 2 papers, with Run 1 papers giving somewhat higher values than Run 2 papers. Run 3 and Run 4 papers were comparable to those of Run 1 and Run 2 papers at loading levels of up to about 22%, but fell dramatically for the Run 4 papers having a 23% loading level. As stated above, high loading levels were not achieved using the Run 3 process.

It can be concluded therefore that although good results are obtainable with all the process variants tried, those in which the cationic and anionic polymers are mixed prior to filler of fibre treatment are less preferred. Of the two other variants, it is preferable to treat the filler rather than the fibre with both cationic and anionic polymers.

EXAMPLE 21

This illustrates a further process in which the fibre is treated with an anionic polymer and the filler is treated first with an anionic polymer and then with cationic polymer. The process is similar to that described in Example 8, except that a more highly charged cationic starch was used, namely "Cato 170", an amine-modified starch supplied by Laing-National Ltd. of Manchester, and that the quantities of materials used differ.

(a) Fibre treatment

A 4% aqueous fibre suspension containing 21 kg of fibre on a dry basis was prepared (the fibre used was the same blend as described in Example 1). 16.3 kg of a 0.5% aqueous solution of an anionic polyacrylamide ("Percol E24") were added to the fibre suspension with stirring. The polyacrylamide content of the suspension was 31.5 g, or 0.15% based on the weight of fibre present.

(b) Filler treatment 15 kg of chalk were slurried in 60 kg water, and 12.0 kg of 0.5% anionic polyacrylamide solution ("Percol E24") were added with stirring. This gave a polyacrylamide content of 60 g, or 0.4% based on the weight of chalk. 28.5 kg of 5% cationic starch solution ("Cato 170") were added with further stirring. The cationic starch addition on a dry basis was 1.43 kg, or 9.5% based on the weight of chalk. The ratio of chalk:cationic starch:anionic polyacrylamide was 250:24:1.

(c) Mixing of filler and fibre suspensions/papermaking

The treated chalk slurry was added to the fibre suspension, at a position in the approach flow system before the refiners, in amounts intended to give chalk levels of about 30%, 45% and 60%, based on the total weight of fibre and chalk, after which the treated fibre suspension was diluted to papermaking consistency. Alkyl ketene dimer sizing agent ("Aquapel 2") was added at the mixing box at a level of 0.02%, based on the total solid material present. The various stocks were drained to produce paper webs of target grammage 100 g $m^{-2}$ in the normal way. A 5% solution of solubilized starch ("Amisol 5592") was applied in each case by means of a size press on the papermachine. The pick-up was such as to produce a solubilized starch content of approximately 5% in the final paper web, based on the fibre content of the web.

(d) Control

This used a conventional retention aid ("Percol 140", a medium molecular weight low charge density cationic polyacrylamide supplied by Allied Colloids Ltd.) added at the headbox, without any separate pre-treatment of the filler or the fibre. The procedure was otherwise as described in (c) above, except that a 15% target loading run was also carried out.

(e) Results Obtained

The papers were subjected to the usual range of tests, but retention values were derived by a comparison of the ash (chalk) content in the sheet with the chalk content of the papermaking stock in the headbox. The results obtained are set out in Table 21 below:

TABLE 21

| Target loading (%) | I/C * | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|---|
| 15 | I | — | — | — | — | — |
| | C | 16 | 85 | 2.6 | 2.8 | 5.9 |
| 30 | I | 25 | 82 | 2.3 | 3.2 | 6.0 |
| | C | 30 | 88 | 2.1 | 2.1 | 4.4 |
| 45 | I | 34 | 91 | 1.9 | 2.6 | 5.4 |
| | C | 39 | 71 | 1.5 | 1.5 | 3.5 |
| 60 | I | 31 | 73 | 2.4 | 2.8 | 6.0 |
| | C | 49 | 84 | 1.4 | 1.0 | 2.5 |

* I = Invention
C = Control

Figure 4:
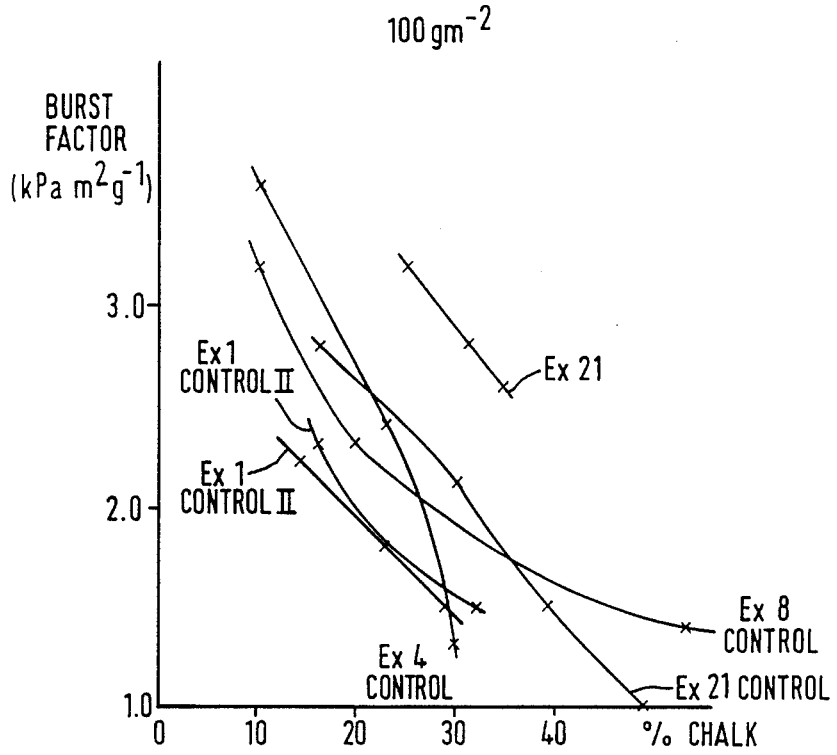
FIG. 4 is a graphical illustration of the results obtained from Example 21 relating to burst values.

It will be seen that with one exception, which was probably anomalous, the retention values obtained were poorer than the control. However, improved strength values were obtained. Whilst this is not entirely surprising, in view of the fact that "Cato 170" is likely to function as a dry strength aid, and that no comparable material was present in the control, it should be noted that the burst factor and breaking length values were significantly better than corresponding controls from previous Examples. This can be seen from FIG. 4 of the accompanying drawings in relation to burst factor values, where values from previous controls are also plotted. The specific bending modulus values were better than most of the previous controls, but not as good as the values obtained in the Example 8 control.

EXAMPLE 22

This illustrates a process which is similar to that of Example 13, but in which a different anionic starch is used, namely "Retabond AP". The use of this starch was illustrated in Examples 15 and 16, but only on a handsheet scale. The present Example was run on a pilot-scale papermaking machine, and utilises a cationic polyacrylamide rather than the AAE copolymer used in Examples 15 and 16.

(a) Fibre treatment

A 4% aqueous fibre suspension containing 14 kg of fibre on a dry basis was prepared (the fibre used was the same blend as described in Example 1). 11.2 kg of a 0.5% solution of cationic polyacrylamide ("Percol 47") were added with stirring, giving a cationic polyacrylamide content of 56 g (0.4% based on weight of fibre).

(b) Filler treatment 10 kg of chalk was slurried in 56 kg water, and 1 kg of a 0.5% solution of cationic polyacrylamide (Percol 47") was added with stirring. This gave a cationic polyacrylamide content of 5 g (0.05% based on the weight of chalk). 10 kg of 5% anionic starch solution ("Retabond AP") were added with further stirring. This gave an anionic starch content of 0.5 kg (5% based on the weight of chalk).

(c) Mixing of filler and fibre suspensions/papermaking

This was as in Example 21, except that no run was carried out at 15% target loading.

(d) Results obtained

The papers were tested and retention values obtained as described in Example 21, and the results obtained are set out in Table 22 below:

TABLE 22

| Target loading (%) | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|
| 30 | 30 | 96 | 2.6 | 2.5 | 5.5 |
| 45 | 41 | 90 | 1.9 | 1.7 | 3.1 |
| 60 | 45 | 88 | 1.7 | 1.4 | 2.7 |

It will be seen that the retention values obtained are higher than those of the Example 21 control. The strength properties in each case were good compared with all previous controls at the lower loading levels, but fell below those of the Example 8 control at higher loading levels (and, in the case of breaking length, also below that of the Example 21 control).

EXAMPLE 23

This illustrates a process similar to that described in Example 22 except that a smaller amount of cationic polyacrylamide was employed for fibre treatment, and also a parallel process in which the cationic polyacrylamide and the anionic starch are mixed before being used to treat the chalk slurry. The amount of cationic polyacrylamide used for fibre treatment was half that used in Example 22 (i.e. 5.6 kg), but the other quantities of material used were as described in Example 22. The results obtained are set out in Table 23 below:

TABLE 23

| Target loading (%) | S/M * | Ash Content (%) | One-pass retention (%) | Specific bending modulus $\times 10^{-6}$ (MD) | Burst factor ($kPam^2g^{-1}$) | Breaking length (km) (MD) |
|---|---|---|---|---|---|---|
| 15 | S | 16 | 61 | 3.1 | 3.3 | 6.5 |
| | M | 15 | 62 | 2.7 | 3.4 | 7.2 |
| 30 | S | 28 | 77 | 2.1 | 2.2 | 4.9 |
| | M | 24 | 80 | 2.2 | 2.5 | 5.0 |
| 45 | S | 40 | 100 | 1.9 | 1.5 | 4.2 |
| | M | 34 | 80 | 1.9 | 1.8 | 4.2 |
| 60 | S | 43 | 91 | 1.6 | 1.3 | 3.4 |
| | M | 41 | 80 | 1.6 | 1.5 | 3.4 |

*S/M = treatment of filler with polacrylamide sequentially/after mixing respectively It will be that sequential treatment produced a marked benefit in retention at high target loading levels compared with mixed treatment, and that strength values were broadly comparable for both types of treatment. A comparison of the sequential treatment results with those of Example 22 produces no clear conclusions as to the preferred level of cationic polyacrylamide treatment.

EXAMPLE 24

This illustrates the use of "Retabond AP" starch at two different treatment level ranges in conjunction in each case with cationic AAE copolymer.

(a) Fibre treatment (for each run)

A 4% aqueous fibre suspension containing 14 kg of fibre on a dry basis was prepared (the fibre used was the same blend as described in Example 1). 0.93 kg of a 5% aqueous solution of AAE copolymer ("Percol 1597") was added to the fibre suspension with stirring. The dry polymer content of the suspension was 46.3 g or 0.33% based on the weight of fibre present.

(b) Filler treatment

A kg of chalk were slurried in B kg of water and C kg of 5% cationic AAE polymer solution ("Percol 1597") were added with stirring. D kg of 5% anionic starch solution ("Retabond AP") were added with further stirring. The values of A, B, C and D varied according to the intended target loading, and were as follows:

| Target Loading | A (kg) | B (kg) | C (kg) | AAE copolymer on chalk (%) | D (kg) | Starch on chalk (%) |
|---|---|---|---|---|---|---|
| (i) Lower starch treatment level range | | | | | | |
| 15 | 5 | 20.0 | 0.33 | 0.33 | 13.2 | 13.2 |
| 30 | 5 | 26.6 | 0.33 | 0.33 | 6.6 | 6.6 |
| 45 | 5 | 28.8 | 0.33 | 0.33 | 4.4 | 4.4 |
| 60 | 7 | 28.4 | 0.46 | 0.33 | 4.6 | 3.3 |
| (ii) Higher starch treatment level range | | | | | | |
| 15 | 5 | 8.3 | 1.2 | 1.2 | 24 | 24 |
| 30 | 5 | 18.3 | 1.2 | 1.2 | 14 | 14 |
| 45 | 5 | 21.3 | 1.2 | 1.2 | 11 | 11 |
| 60 | — | — | — | — | — | — |

For the lower starch treatment level, the ratio of anionic starch to total cationic polymer usage (i.e. that used for filler and for fibre treatment) was 6:1 in each case. For the higher treatment level, the ratio was 6.5:1.

(c) Mixing of filler and fibre suspensions/papermaking

This was in each case as described in part (c) of Example 21.

(d) Results obtained

The papers were tested and retention values obtained as described in Example 21, and the results obtained are set out in Table 24 below:

TABLE 24

| Target loading (%) | L/H * | Ash Content (%) | One-pass-retention (%) | Specific bending modulus $\times 10^{-6}$ (MD) | Burst factor ($kPam^2g^{-1}$) | Breaking length (Km) (MD) |
|---|---|---|---|---|---|---|
| 15 | L | 14 | 88 | 2.1 | 4.2 | 7.4 |
| | H | 16 | 96 | 2.4 | 4.6 | 7.7 |
| 30 | L | 23 | 90 | 1.9 | 3.3 | 6.6 |
| | H | 32 | — | 1.7 | 3.2 | 7.5 |
| 45 | L | 34 | 96 | 1.7 | 2.3 | 4.6 |
| | H | 38 | 97 | 2.1 | 2.7 | 5.2 |
| 60 | L | 47 | — | 1.8 | 1.6 | 3.7 |
| | H | — | — | — | — | — |

*L/H = Lower and higher level starch treatment ranges.

Figure 5:
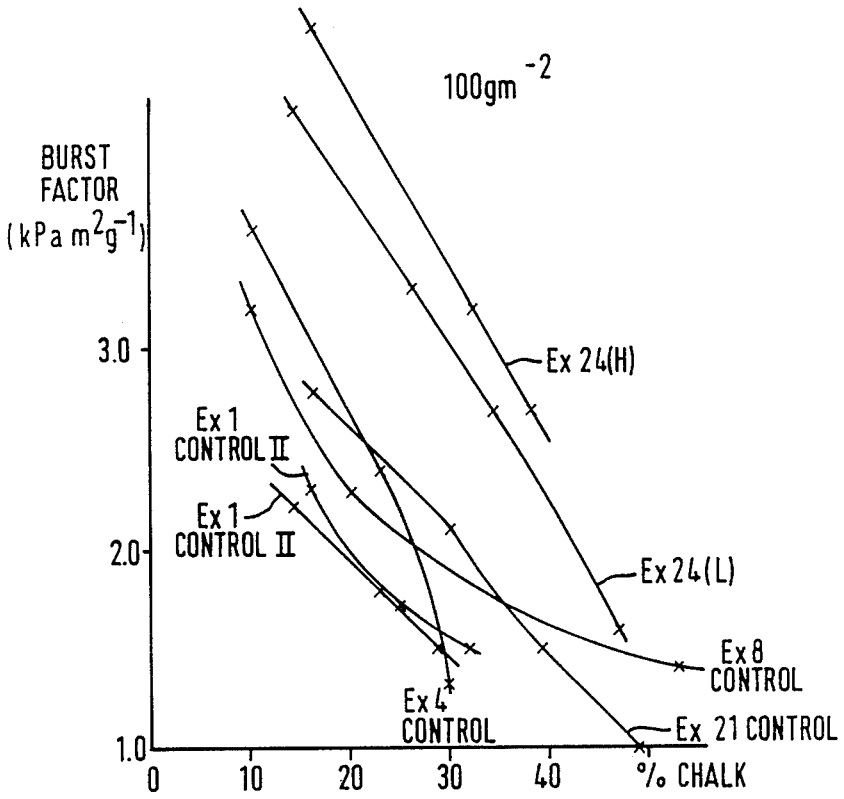
FIG. 5 is a graphical illustration of the results obtained from Example 24 relating to burst values.

It will be seen that in general, the higher starch treatment level gave better results, although in some cases there was little difference. All the retention values were good compared with the Example 21 control, and burst factor and breaking length values were significantly better than the controls from all previous Examples. Specific bending modulus values were not as good as the Example 8 control, but appeared better than the other controls at higher loading levels. The burst factor values are depicted on FIG. 5 of the accompanying drawings, on which the control values from previous Examples are also plotted.

EXAMPLE 25

This illustrates the use on a full size papermachine of a process in which the fibre is treated with an anionic polyacrylamide and the filler is treated first with anionic polyacrylamide and then with cationic starch.

(a) Fibre treatment

A 4% aqueous fibre suspension containing 600 kg of fibre on a dry basis was prepared. 240 kg of a 0.5% aqueous solution of an anionic polyacrylamide ("Percol E24") were added to the fibre suspension with stirring, either during refining or immediately afterwards. The polyacrylamide content of the suspension was 1.2 kg, or 0.2% based on the weight of fibre present.

The procedure described above was repeated twice more so as to allow a total of three runs with the treated fibre, one of which was for use in a control run (see below). Two batches of untreated fibre suspension were also made up for use in control runs.

(b) Filler treatment 140 kg of chalk were slurried in 525 kg water, and 195 kg of 0.5% anionic polyacrylamide solution ("Percol E24") were added with stirring. This gave a polyacrylamide content of 0.975 g, or 0.7% based on the weight of chalk. 230 kg of 5% cationic starch solution ("Amisol 5906") were added with further stirring. The cationic starch addition on a dry basis was 11.5 kg, or 8.2% based on the weight of chalk. The ratio of chalk:cationic starch:anionic polyacrylamide was approximately 144:12:1. This procedure was then repeated so as to produce sufficient treated chalk for two runs.

(c) Mixing of filler and fibre suspensions/papermaking

Treated chalk slurry was added to the fibre suspension at the machine chest in two runs in amounts intended to give chalk levels of about 15% and 35% respectively, based on the total weight of fibre and chalk, after which the treated fibre suspension was diluted to papermaking consistency. Alkyl ketene dimer sizing was employed. An optical brightening agent and a biocide were also present in conventional amounts. The stocks were drained to produce paper webs of target grammage 100 g $m^{-2}$ in the normal way. A solution of solubilized starches was applied in each case by means of a size press on the papermachine.

(d) Controls

Three controls were run, one with an 8% non-treated chalk target loading and the other two with a 15% non-treated chalk target loading. For one of the 15% target loading runs, the fibre used was treated as in (a) above. For the other 15% target loading run, and for the 8% target loading run, a retention aid was used at an addition level of 0.05%, based on the weight of dry fibre.

(e) Results obtained

The papers were subjected to the usual range of tests, but retention values were derived by a comparison of the ash (chalk) content in the sheet with the chalk content of the papermaking stock in the headbox. The results obtained are set out in Table 25 below:

TABLE 25

| Target loading (%) | Chalk content of head-box Stock (%) | Ash Con-tent (%) | One-pass retention (%) (approx.) | Specific bending modulus $\times 10^{-6}$ (MD) | Burst (factor) ($kPam^2g^{-1}$) | Break-ing length (km) (MD) |
|---|---|---|---|---|---|---|
| 8 (C) | 16 | 8.3 | 52 | 2.1 | 2.1 | 2.1 |
| 15 (C)* | 24 | 13.5 | 56 | 2.1 | 2.0 | 4.9 |
| 15 (C) | 28 | 17.7 | 63 | 1.8 | 1.8 | 4.6 |
| 15 (I) | 22 | 14.0 | 64 | 1.9 | 2.1 | 5.4 |
| 15 (I) | 51 | 36.4 | 71 | 1.5 | 1.4 | 3.7 |

C = Control (* indicates with fibre treatment as in (a));
I = Invention

Figure 6:
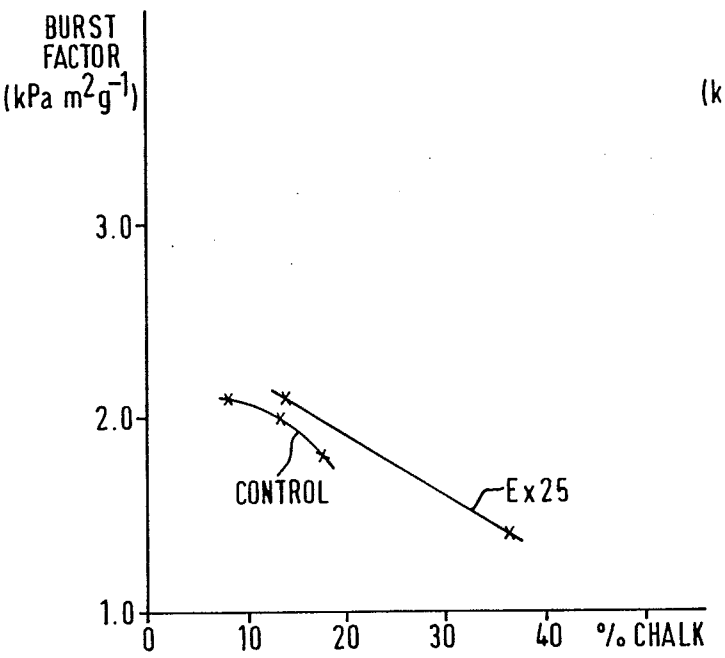
FIG. 6 is a graphical illustration of the results obtained from Example 25 relating a burst values.

It will be seen that the best retention values were obtained with the process according to the invention, although at 15% target loading, one (but not both) of the controls gave substantially the same retention values. The burst factor results are depicted graphically in FIG. 6, and it will be seen that those of the paper according to to the invention are superior to the control. The specific bending modulus values for the paper according to the invention with 14% ash content are somewhat worse than those for the control paper with 13.5% ash content, but for the same two papers, the breaking length value for the paper according to the invention is considerably better than that for the control paper.

EXAMPLE 26

This Example is similar to Example 25, but relates to the production of a lightweight paper.

(a) Fibre treatment

A 4% aqueous fibre suspension containing 1000 kg of fibre on a dry basis was prepared (the fibre blend and degree of refining was the same as described in Example 1 except that the eucalyptus and softwood pulps were refined separately). 400 kg of a 0.5% aqueous solution of an anionic polyacrylamide ("Percol E24") were added to the eucalyptus fibre suspension with stirring before mixing with the softwood fibres. The polyacrylamide content of the suspension was 2 kg, or 0.2% based on the total weight of eucalyptus and softwood fibre present.

The procedure described above was repeated three times so as to allow a total of four runs with the treated fibre.

(b) Filler treatment 125 kg of kaolin were slurried in 675 kg water, and 50 kg of 0.5% anionic polyacrylamide solution ("Percol E24") were added with stirring. This gave a polyacrylamide content of 0.25 kg, or 0.2% based on the weight of kaolin. 200 kg of 5% cationic starch solution ("Amisol 5906") were added with further stirring. The cationic starch addition on a dry basis was 10 kg, or 8.0% based on the weight of kaolin. The ratio of kaolin:-cationic starch: anionic polyacrylamide was 500:40:1.

The procedure was repeated a further three times, but with different quantities of material in the same 500:40:1 ratio, as follows:

| Kaolin (kg) | Water (kg) | 0.5% anionic Polyacrylamide solution (kg) | 5% cationic starch solution (kg) |
|---|---|---|---|
| 175 | 475 | 70 | 280 |
| 225 | 1325 | 90 | 360 |

-continued

| Kaolin (kg) | Water (kg) | 0.5% anionic Polyacrylamide solution (kg) | 5% cationic starch solution (kg) |
|---|---|---|---|
| 150 | 550 | 60 | 240 |

(c) Mixing of filler and fibre suspensions/papermaking

Treated chalk slurry was added to the fibre suspension, at the machine chest in four runs in amounts intended to give kaolin levels of about 8%, 11%, 15% and 20%, based on the total weight of fibre and kaolin, after which the treated fibre suspension was diluted to papermaking consistency. Rosin/alum sizing was employed. Biocides and other standard additives were also used. The various stocks were drained to produce paper webs of target grammage 49 g $m^{-2}$ in the normal way. A 4% solution of solubilized starch was applied in each case by means of a size press on the papermachine. The pick-up was such as to produce a solubilized starch content of approximately 2% in the final paper web, based on the fibre content of the web.

(d) Control

Two identical control runs were carried out, with target kaolin loadings of 8%. Neither the fibre nor the kaolin was treated as described above, but 11 kg of dry starch ("Retabond AP") was added to the eucalyptus pulp used in each control run as a conventional strength aid. A conventional retention aid was also used. The procedure was otherwise as described in (c) above.

(e) Results Obtained

The papers were subjected to the usual range of tests, but retention values were derived by a comparison of the ash (kaolin) content in the sheet with the kaolin content of the papermaking stock in the headbox. The results obtained are set out in Table 26 below:

TABLE 26

| Target loading (%) | Koalin content of headbox Stock (%) | Ash Content (%) | One-pass retention (%) (approx.) | Specific bending modulus $\times 10^{-6}$ (MD) | Burst factor ($kPam^2g^{-1}$) | Breaking length (km) (MD) |
|---|---|---|---|---|---|---|
| 8 (C) | 15.1 | 7.2 | 48 | 426 | 3.0 | 6.5 |
| 8 | 19.0 | 6.8 | 36 | 366 | 3.5 | 6.3 |
| 11 | 24.2 | 9.2 | 38 | 390 | 3.5 | 6.9 |
| 15 | 29.3 | 12.3 | 42 | 381 | 3.0 | 5.5 |
| 20 | 46.6 | 18.0 | 39 | 340 | 2.6 | 5.1 |
| 8 (C) | 15.6 | 8.2 | 53 | 350 | 2.8 | 5.4 |

C = Control

Figure 7:
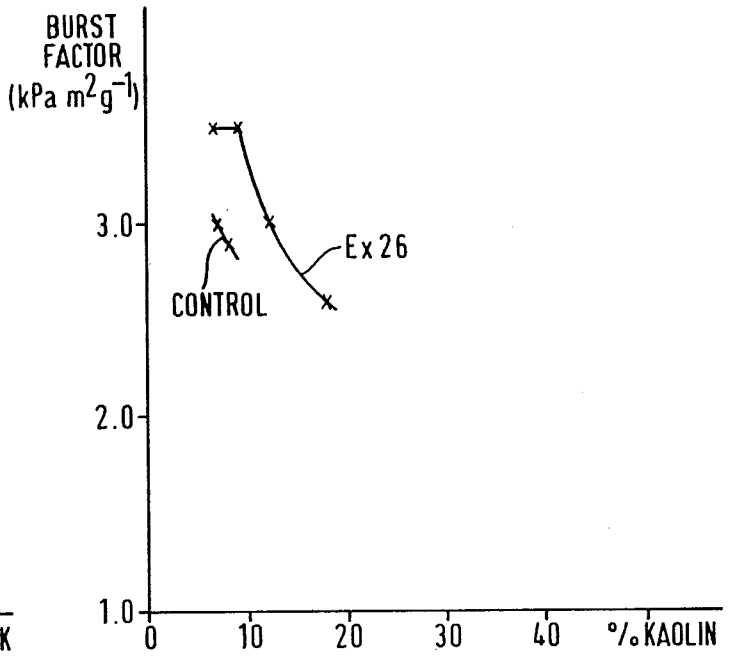
FIG. 7 is a graphical illustration of the results obtained from Example 26 relating to burst values.

It will be seen that the control runs gave the best retention values. The burst factor results are depicted graphically in FIG. 7, and it will be seen that the papers according to the invention are superior, from both the standpoints of strength for a given loading level and loading present in a paper of given strength. The breaking length and specific bending modulus data appear inconclusive. It will be noted that the specific bending modulus values are of a different numerical order than those quoted in other Examples. This is because the lightweight nature of the paper required the use of a different stiffness measuring instrument from that used in other Examples.

It will be noted that the two control runs, which should have given substantially identical results, in fact gave rise to widely differing results. The control values obtained must therefore be treated with caution.

EXAMPLE 27

This illustrates the use of a range of alternative anionic polymers for treating the fibre and the filler. A parallel experiment was also carried out using the anionic polyacrylamide used in previous Examples, in order to axovide a standard of reference.

The polymers were all used in 0.4% aqueous solution, and their chemical nature and the concentration of the aqueous solution are set out below:

| Anionic Polymer | Trade Name | Supplier |
|---|---|---|
| (1) Anionic polyacrlamide (reference) | "Percol E24" | Allied Colloids Ltd |
| (2) Vinyl methyl ether/ maleic anhydride copolymer (PVM/MA) | "AN 903" | GAF |
| (3) Sodium alginate | "Manytex RB" | Alginate Industries |
| (4) Carboxymethyl cellulose (CMC) | "FF5" | Finnfix |
| (5) Anionic starch (oxidised maize starch) | "Flo-Kote 64" | National Starch & Chemical Corporation |

The following procedure was carried out for each of the polymers listed above:

(a) Fibre Treatment 450 g of a 4% aqueous fibre suspension (18 g fibre on a dry basis) were mixed with 9 l water and 9 g of polymer solution were added (this quantity of polymer represented a polymer treatment level of 0.2% on a dry basis, based on the dry weight of fibre). This procedure was carried out three times for each polymer, once for each of three different loading levels (see below).

(b) Filler Treatment 3.2 g of chalk was slurried in about 100 g water and sufficient of the polymer solution was added with stirring to provide a polymer treatment level of 0.2% on a dry basis, based on the dry weight of chalk. An amount of 5% aqueous solution of cationic starch ("Amisol 5906") sufficient to give a starch treatment level of 8% on a dry basis, based on the dry weight of chalk, was then added with stirring.

The above procedure was repeated using 7.7 g and 14.7 g chalk.

(c) Mixing of filler and fibre suspensions/papermaking/testing

Each treated filler suspension was mixed with a treated fibre suspension, with stirring, and the resulting stock was used to produce round handsheets of 60 g $m^{-2}$ target grammage, using a British Standard Sheetmaking machine. The quantities of filler and fibre used were such as to give target loadings of 15%, 30% and 45%. A control was also run using untreated fibre and chalk which had been treated only with cationic starch at an 8% treatment level, based on the dry weight of chalk. The ash content and burst factor values were determined for each sheet, and the results are set out in Table 27 below:

TABLE 27

| Polymer | Target Loading % | Ash Content % | retention % | Burst Factor ($kPam^2g^{-1}$) |
|---|---|---|---|---|
| Anionic | 15 | 4.6 | 31 | 7.1 |
| | 30 | 12.3 | 41 | 6.8 |
| acrylamide | 45 | 18.5 | 41 | 5.6 |

TABLE 27-continued

| Polymer | Target Loading % | Ash Content % | retention % | Burst Factor ($kPam^2g^{-1}$) |
|---|---|---|---|---|
| PVM/MA | 15 | 3.4 | 23 | 7.5 |
| | 30 | 3.6 | 12 | 7.0 |
| | 45 | 7.9 | 18 | 6.6 |
| Sodium Alginate | 15 | 2.5 | 17 | 7.5 |
| | 30 | 3.6 | 12 | 8.2 |
| | 45 | 6.8 | 15 | 7.0 |
| CMC | 15 | 2.3 | 15 | 8.3 |
| | 30 | 2.7 | 9 | 7.5 |
| | 45 | 7.0 | 16 | 6.6 |
| Anionic Starch | 15 | 1.6 | 11 | 7.4 |
| | 30 | 4.1 | 14 | 6.9 |
| | 45 | 6.4 | 14 | 6.7 |
| Control | 15 | 5.3 | 35 | 4.9 |
| | 30 | 8.6 | 29 | 4.8 |
| | 45 | 12.2 | 27 | 4.6 |

Figure 8:
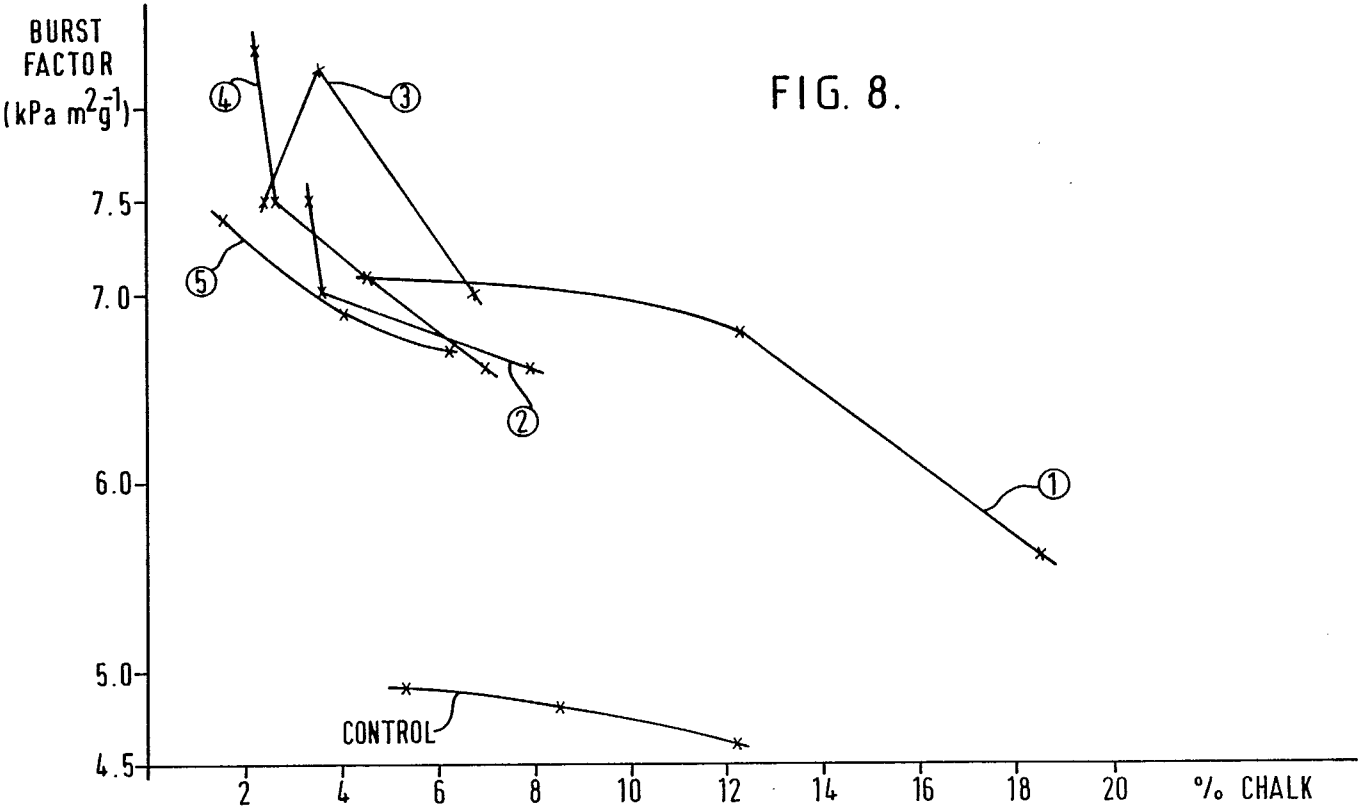
FIG. 8 is a graphical illustration of the results obtained from Example 27 relating to burst values.

The burst factor results are depicted graphically in FIG. 8, in which the numbering of the curves corresponds to the numbering in the list of polymers. It will be seen that the use of anionic polyacrylamide gave much greater retention values than the other polymers (although the results were erratic). The retention values for the control were also better than the other polymers and almost as good as for the anionic polyacrylamide. The burst factor values for the various polymers were of the same order for comparable ash contents. Since the merit of the polyacrylamide system has been demonstrated in earlier Examples, the achievement of comparable burst factor values for the other polymers demonstrates the suitability of these other polymers for use in the present process.

EXAMPLE 28

This illustrates the use of vinyl methyl ether/maleic anhydride copolymer (PVM/MA) as an anionic polymer in a process in which the fibre and filler are treated with a cationic polymer.

(a) Fibre treatment 450 g of a 4% aqueous fibre suspension (18 g fibre on a dry basis) were mixed with 9 l water and 1.08 g of a 5% solution of AAE copolymer ("Percol 1597"(were added (this quantity of polymer represented a polymer treatment level of 0.3% on a dry basis, based on the dry weight of fibre). This procedure was carried out three times for each polymer, once for each of three different loading levels.

(b) Filler treatment 4.5 g of chalk were slurred in about 100 g water and 0.27 g AAE copolymer solution was added with stirring (this gave an AAE copolymer treatment level of 0.3% on a dry basis, based on the dry weight of chalk). 1.09 g of 5% PVM/MA solution were then added with stirring, giving a PVM/MA treatment level of 1.2 % on a dry basis, based on the dry weight of chalk.

The above procedure was then repeated twice, using 12 g and 27 g of chalk, 0.72 g and 1.62 g of AAE copolymer solution, and 2.91 g and 6.56 g of PVM/MA solution.

The treatment levels thus remained the same.

(c) Mixing of filler and fibre suspensions/papermaking/testing

Each treated filler suspension was mixed with stirring with a treated fibre suspension, giving papermaking stocks with target loadings of 20%, 40% and 60%. These stocks were each used to produce round handsheets of 60 g $m^{-2}$ target grammage, using a British Standard Sheetmaking Machine. The ash content and burst factor values were determined for each sheet and the results are set out in Table 28 below:

TABLE 28

| Target Loading (%) | Ash Content (%) | Retention (%) | Burst factor (kPa $m^2g^{-1}$) |
|---|---|---|---|
| 20 | 12 | 60 | 3.4 |
| 40 | 23 | 58 | 2.4 |
| 60 | 29 | 48 | 2.1 |

EXAMPLE 29

This illustrates a process in which the fibre and filler was treated with an anionic polyacrylamide, and the filler is further treated with a cationic starch, but in which a different range of ratios of filler:starch:polyacrylamide is used compared with the ratios exemplified earlier. Ten different runs were carried out.

(a) Fibre treatment

A 4% aqueous fibre suspension containing 36 kg fibre on a dry basis was prepared (the fibre used was the same blend as described in Example 1). 14.4 kg of a 0.5% aqueous solution of an anionic polyacrylamide ("Percol E24") were added to the fibre suspension with stirring. The polyacrylamide content of the suspension was 72 g, or 0.2%, based on the weight of dry fibre present. The treated fibre suspension was then used as a masterbatch for ten different papermaking runs.

(b) Filler treatment

Chalk was slurried in water, and 0.5% anionic polyacrylamide solution ("Percol E24") was added with stirring. 5% cationic starch solution ("Amisol 5906") was then added with further stirring. The quantities of material used were as follows:

| Runs Nos. | Chalk (kg) | Water (kg) | 0.5% PA soln. (kg) | 5% starch soln. (kg) |
|---|---|---|---|---|
| 1–3 | 10 | 36 | 13.8 | 16.8 |
| 4–6 | 10 | 51 | 7.0 | 8.4 |
| 7–10 | 10 | 56 | 4.7 | 5.6 |

For Runs Nos. 1–3 the anionic polyacrylamide and cationic starch treatment levels were 0.69% and 8.4% respectively on a dry basis, based on the dry weight of chalk, and the ratio of chalk:cationic starch:anionic polyacrylamide was 144:12:1. This is the same as in some previous Examples, and therefore affords a standard of comparison. For Runs No. 4–6, the respective treatment levels were 0.35% and 4.2%, and the ratio was 288:12:1. For Runs No. 7–10, the respective treatment levels were 0.235% and 2.8%, and the ratio was 432:12:1.

(c) Mixing of filler and fibre suspensions/papermaking/testing

The treated chalk slurry was added to the fibre suspension at a position such as to give good mixing in amounts intended to give chalk levels of about 15% (Runs 1, 4 and 7), 30% (Runs 2, 5 and 8), 45% (Runs 3, 6and 9) and 60% (Run 10) based on the total weight of fibre and chalk. The resulting chalk/fibre suspension was diluted to papermaking consistency. Alkyl ketene dimer sizing agent ("Aquapel 360×") was added at the mixing box at a level of 0.1%, based on the total weight of fibre and filler present. The various stocks were drained to produce paper webs of target grammage 100 g $m^{-2}$ in the normal way. A 5% solution of solubilized starch was applied in each case by means of a size press on the papermachine. The papers were subjected to the usual range of tests, and retention values were derived by a comparison of the ash (chalk) content in the sheet with the chalk content of the papermaking stock in the headbox. The results obtained are set out in Table 29 below:

TABLE 29

| Run No. | Target loading (%) | Ash Content (%) | One-pass retention (%) (approx.) | Burst factor ($kPam^2g^{-1}$) | Specific Bending modulus $\times 10^{-6}$ (MD) | Breaking length (km) (MD) |
|---|---|---|---|---|---|---|
| 1 | 15 | 21 | 65 | 3.1 | 2.5 | 7.3 |
| 2 | 30 | 30 | 93 | 2.5 | 2.5 | 5.5 |
| 3 | 45 | 40 | 93 | 2.1 | 2.2 | 5.1 |
| 4 | 45 | 40 | 88 | 2.0 | 2.4 | 4.3 |
| 5 | 30 | 31 | 85 | 2.3 | 2.3 | 5.5 |
| 6 | 15 | 24 | 88 | 2.6 | 2.1 | 5.8 |
| 7 | 15 | 21 | 84 | 2.9 | 2.4 | 6.1 |
| 8 | 30 | 24 | 80 | 2.7 | 2.2 | 5.5 |
| 9 | 45 | 32 | 77 | 2.3 | 1.9 | 5.1 |
| 10 | 60 | 41 | 76 | 1.9 | 2.2 | 4.1 |

Figure 9:
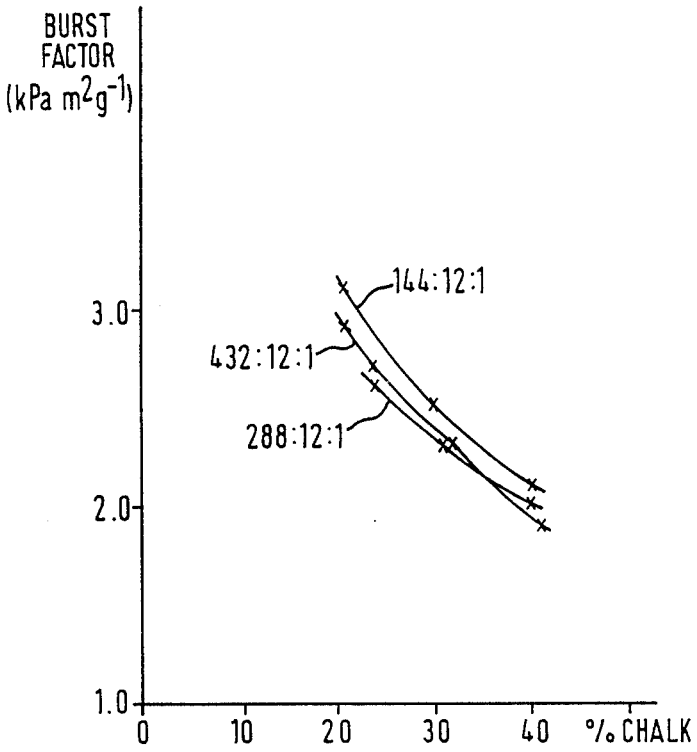
FIG. 9 is a graphical illustration of the results obtained from Example 29 relating to burst values.

It will be seen that in general the 144:12:1 ratio (Runs Nos. 1–3) gave better retention values (with the exception of Run No. 1, which was perhaps anomalous) than ratio 288:12:1 (Runs No. 4–6) which in turn was better than ratio 432:12:1. The burst factor values are depicted graphically in FIG. 9. It will be seen that the 144:12:1 ratio gave the best results followed by the 432:12:1 ratio, followed by the 288:12:1 ratio. This same trend is apparent in relation to the breaking length values. The specific bending modulus values are erratic and it is difficult to draw clear conclusions.

We claim:

1. A process for the production of loaded paper from papermaking fibre and filler, comprising the steps of:
   (a) treating the papermaking fibre in an aqueous medium with a charged synthetic polymer;
   (b) separately treating the filler in an aqueous medium with a charged synthetic polymer, with the proviso that if the charged synthetic polymer used to treat the filler is anionic it is selected from papermaking flocculents and retention aids;
   (c) selecting the charged synthetic polymer used in step (a) and the charged synthetic polymer used in step (b) such that both have the same charge polarity;
   (d) additionally treating the filler with a charged polymer of opposite charge polarity from that of the polymer(s) used in steps (a) and (b);
   (e) mixing aqueous suspensions of treated filler and treated papermaking fibre from steps (a), (b) and (d) to form a papermaking stock, diluting as necessary before, during or after the mixing operation; and
   (f) draining the papermaking stock to form a loaded paper web, wherein the filler, papermaking fibre and charged polymers are used in amounts effective to produce loaded paper.

2. A process as claimed in claim 1, wherein the polymer used in the step (a) treatment is a cationic papermaking retention aid or flocculant.

3. A process as claimed in claim 2 wherein the polymer used in the step (a) treatment is a cationic polyacrylamide or a cationic amine/amide/epichlorohydrin copolymer.

4. A process as claimed in claim 3, wherein the polymer used in the step (a) treatment is used in an amount of at least 0.15% by weight, based on the dry weight of the papermaking fibre.

5. A process as claimed in claim 4, wherein the polymer used in the step (a) treatment is used in an amount of from 0.2 to 0.4% by weight, based on the dry weight of the papermaking fibre.

6. A process as claimed in claim 1, wherein the polymer used in the step (b) treatment is a cationic papermaking retention aid or flocculant.

7. A process as claimed in claim 6, wherein the polymer used in the step (b) treatment is a cationic polyacrylamide or a cationic amine/amide/epichlorohydrin copolymer.

8. A process as claimed in claim 6 or claim 7, wherein the polymer used in the step (b) treatment is used in an amount of at least 0.1% by weight, based on the dry weight of the filler.

9. A process as claimed in claim 8, wherein the polymer used in the step (b) treatment is used in an amount of from 0.2 to 1.0% by weight, based on the dry weight of the filler.

10. A process as claimed in claim 9, wherein the polymer used in the step (b) treatment is used in an amount of from 0.3 to 1.0% by weight, based on the dry weight of the filler.

11. A process as claimed in claim 2, wherein the polymer used in the step (c) treatment is an anionic starch.

12. A process as claimed in claim 11, wherein the anionic starch is used in an amount of at least 4% by weight, based on the dry weight of the filler.

13. A process as claimed in claim 12, wherein the anionic starch is used in an amount of from 5 to 10% by weight, based on the dry weight of the filler.

14. A process as claimed in claim 11, wherein the weight ratio on a dry basis of the amounts of polymer used in steps (b) and (c) is from 1:6 to 1:40.

15. A process as claimed in claim 14, wherein said weight ratio is from 1:6 to 1:14.

16. A process as claimed in claim 1, wherein the polymer used in the step (a) treatment is an anionic papermaking retention aid or flocculant.

17. A process as claimed in claim 16, wherein the polymer used in the step (a) treatment is an anionic polyacrylamide.

18. A process as claimed in claim 16 or claim 17, wherein the polymer used in the step (a) treatment is used in an amount of at least 0.15% by weight, based on the dry weight of the papermaking fibre.

19. A process as claimed in claim 18 wherein the polymer used in the step (a) treatment is used in an amount of from 0.2 to 0.4% by weight, based on the dry weight of the papermaking fibre.

20. A process as claimed in claim 1, wherein the polymer used in step (b) is an anionic papermaking retention aid or flocculant.

21. A process as claimed in claim 20, wherein the polymer used in step (b) is an anionic polyacrylamide.

22. A process as claimed in claim 20 or 21, wherein the polymer used in the step (b) treatment is used in an amount of at least 0.1% by weight, based on the dry weight of the filler.

23. A process as claimed in claim 22, wherein the polymer used in the step (b) treatment is used in an amount of from 0.2 to 1.0% by weight, based on the dry weight of the filler.

24. A process as claimed in claim 16, wherein the polymer used in the step (c) treatment is a cationic starch.

25. A process as claimed in claim 24, wherein the cationic starch is used in an amount of at least 4% by weight, based on the dry weight of the filler.

26. A process as claimed in claim 25, wherein the cationic starch is used in an amount of 8 to 10% by weight, based on the dry weight of the filler.

27. A process as claimed in claim 24, wherein the weight ratio on a dry basis of the amounts of polymer used in steps (b) and (c) is from 1:12 to 1:100.

28. A process as claimed in claim 27, wherein said weight ratio is from 1:24 to 1:40.

29. A process for the production of loaded paper from paper making fibre and filler, comprising the steps of:

(a) treating the papermaking fibre in an aqueous medium with a cationic synthetic polymer;
(b) separately treating the filler in an aqueous medium with a cationic synthetic polymer;
(c) treating the thus-treated filler with an anionic polymer;
(d) mixing aqueous suspensions of treated papermaking fibre from step (a) and treated filler from steps (b) and (c) to form a papermaking stock, diluting as necessary before, during or after the papermaking operation; and
(e) draining the papermaking stock to form a loaded paper web, wherein the filler, papermaking fibre and charged polymers are used in amounts effective to produce loaded paper.

30. A process as claimed in claim 29, wherein the polymer used in both steps (a) and (b) is a cationic papermaking retention aid or flocculant and the polymer used in step (c) is an anionic starch.

31. A process as claimed in claim 30 wherein the polymer used in both steps (a) and (b) is a cationic polyacrylamide or a cationic amine/amide/epichlorohydrin copolymer.

32. A process as claimed in claim 31, wherein the polymer used in the step (a) and (b) treatments is used in an amount of from 0.2 to 1.0% by weight, based on the dry weight of the papermaking fibre or filler, and the anionic starch is used in an amount of from 5 to 10% by weight, based on the dry weight of the filler.

33. A process for the production of loaded paper from papermaking fibre and filler, comprising the steps of:

(a) treating the papermaking fibre in an aqueous medium with an anionic synthetic polymer;
(b) separately treating the filler in an aqueous medium with an anionic synthetic polymer wherein the polymer is selected from papermaking flocculents and retention aids;
(c) treating the thus-treated filler with a cationic polymer;
(d) mixing aqueous suspensions of treated papermaking fibre from step (a) and treated filler from steps (b) and (c) to form a papermaking stock, diluting as necessary before, during or after the papermaking operation; and
(e) draining the papermaking stock to form a loaded paper web, wherein the filler, papermaking fibre and charged polymers are used in amounts effective to produce loaded paper.

34. A process as claimed in claim 33, wherein the polymer used in both steps (a) and (b) is an anionic papermaking retention aid or flocculant and the polymer used in step (c) is a cationic starch.

35. A process as claimed in claim 34 wherein the polymer used in both steps (a) and (b) is an anionic polyacrylamide.

36. A process as claimed in claim 35, wherein the polymer used in the step (a) and (b) treatments is used in an amount of from 0.2 to 0.4% by weight, based on the dry weight of the papermaking fibre or filler, and the cationic starch is used in an amount of from 8 to 10% by weight, based on the dry weight of the filler.

37. Loaded paper made by a process as claimed in claims 1, 29 or 33.

* * * * *